US011599057B2

(12) United States Patent
Yamagishi

(10) Patent No.: US 11,599,057 B2
(45) Date of Patent: Mar. 7, 2023

(54) DEVELOPING DEVICE, IMAGE FORMING APPARATUS INCLUDING DEVELOPING DEVICE

(71) Applicant: KYOCERA Document Solutions Inc., Osaka (JP)

(72) Inventor: Rei Yamagishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/649,319

(22) Filed: Jan. 28, 2022

(65) Prior Publication Data

US 2022/0253014 A1 Aug. 11, 2022

(30) Foreign Application Priority Data

Feb. 5, 2021 (JP) ..... JP2021-017004

(51) Int. Cl.
*G03G 21/16* (2006.01)
*G03G 15/08* (2006.01)

(52) U.S. Cl.
CPC ..... *G03G 21/1676* (2013.01); *G03G 15/0808* (2013.01); *G03G 21/1652* (2013.01); *G03G 2221/1884* (2013.01)

(58) Field of Classification Search
CPC ..... G03G 15/065; G03G 15/0808; G03G 15/0896; G03G 21/1652; G03G 21/1676; G03G 21/1821; G03G 21/1853; G03G 21/1871; G03G 2221/1654; G03G 2221/1884
See application file for complete search history.

(56) References Cited

U.S. PATENT DOCUMENTS

2016/0223983 A1 8/2016 Taguchi et al.
2020/0310343 A1* 10/2020 Itabashi ..... G03G 21/1821
2021/0018859 A1 1/2021 Fukasawa et al.
2021/0397121 A1* 12/2021 Uohashi ..... G03G 21/1821

FOREIGN PATENT DOCUMENTS

EP 2871529 A1 5/2015
JP 2012237849 A 12/2012

OTHER PUBLICATIONS

European Patent Office, Extended European Search Report Issued in Application No. 22154450.5, dated May 18, 2022, Germany, 8 pages.

* cited by examiner

*Primary Examiner* — Sophia S Chen
(74) *Attorney, Agent, or Firm* — Alleman Hall Creasman & Tuttle LLP

(57) ABSTRACT

A developing device is detachably supported by an image forming apparatus. The developing device includes a housing that can store developer inside the housing, at least one rotating member rotatably provided for the housing, a first support shaft composed of a conductive member and disposed at an axial end of the rotating member, and a support member including a first bearing portion that supports the first support shaft and constituting a side face of the housing in an axial direction of the rotating member. The first bearing portion includes a first guide portion. The first guide portion protrudes outward from an outer surface of the support member and configured to be guided to an installation position of the developing device during installation of the developing device in the image forming apparatus.

5 Claims, 23 Drawing Sheets

DEVELOPING DEVICE, IMAGE FORMING APPARATUS INCLUDING DEVELOPING DEVICE

INCORPORATION BY REFERENCE

This application is based upon and claims the benefit of priority from the corresponding Japanese Patent Application No. 2021-017004 filed on Feb. 5, 2021, the entire contents of which are incorporated herein by reference.

BACKGROUND

The present disclosure relates to developing devices detachable from image forming apparatuses including copiers and multifunction peripherals.

An electrophotographic image forming apparatus includes a developing device that develops electrostatic latent images on a photoconductor drum using toner. The developing device includes a developing roller rotatably supported inside the housing of the developing device and supplies toner stored inside the housing from the developing roller to the photoconductor drum to perform development.

The developing roller of the developing device deteriorates over time and causes development failure. To maintain image quality, the developing device is replaced with a new developing device after a predetermined period of time. In addition, in a case where the developing device includes a toner storing portion integral thereto, the developing device cannot perform development when the toner inside the toner storing portion runs out. Accordingly, the developing device is replaced with another developing device filled with toner. For these reasons, a typical image forming apparatus is configured to support a developing device such that the developing device is detachable and replaceable.

To guide the developing device smoothly to a predetermined installation position, the developing device is provided with guide members on the housing thereof. In a case where the developing device is installed in the image forming apparatus in a direction perpendicular to the central axis of the photoconductor drum, the guide members may be disposed on both side parts of the developing device in the width direction. Moreover, a rotating member such as the developing roller is disposed to face the photoconductor drum, and bearing portions for supporting the support shaft of the rotating member are disposed on the side parts. Furthermore, the developing device is provided with other members such as a power receiving member for receiving a developing bias and supplying the developing bias to the developing roller.

SUMMARY

A developing device according to an aspect of the present disclosure is detachably supported by an image forming apparatus. The developing device includes a housing that can store developer inside the housing, at least one rotating member rotatably provided for the housing, a first support shaft composed of a conductive member and disposed at an axial end of the rotating member, and a support member including a first bearing portion that supports the first support shaft and constituting a side face of the housing in an axial direction of the rotating member. The first bearing portion includes a first guide portion. The first guide portion protrudes outward from an outer surface of the support member and configured to be guided to an installation position of the developing device during installation of the developing device in the image forming apparatus.

An image forming apparatus according to another aspect of the present disclosure includes the developing device and a photoconductor drum having a surface on which a toner image is formed through a development process performed by the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
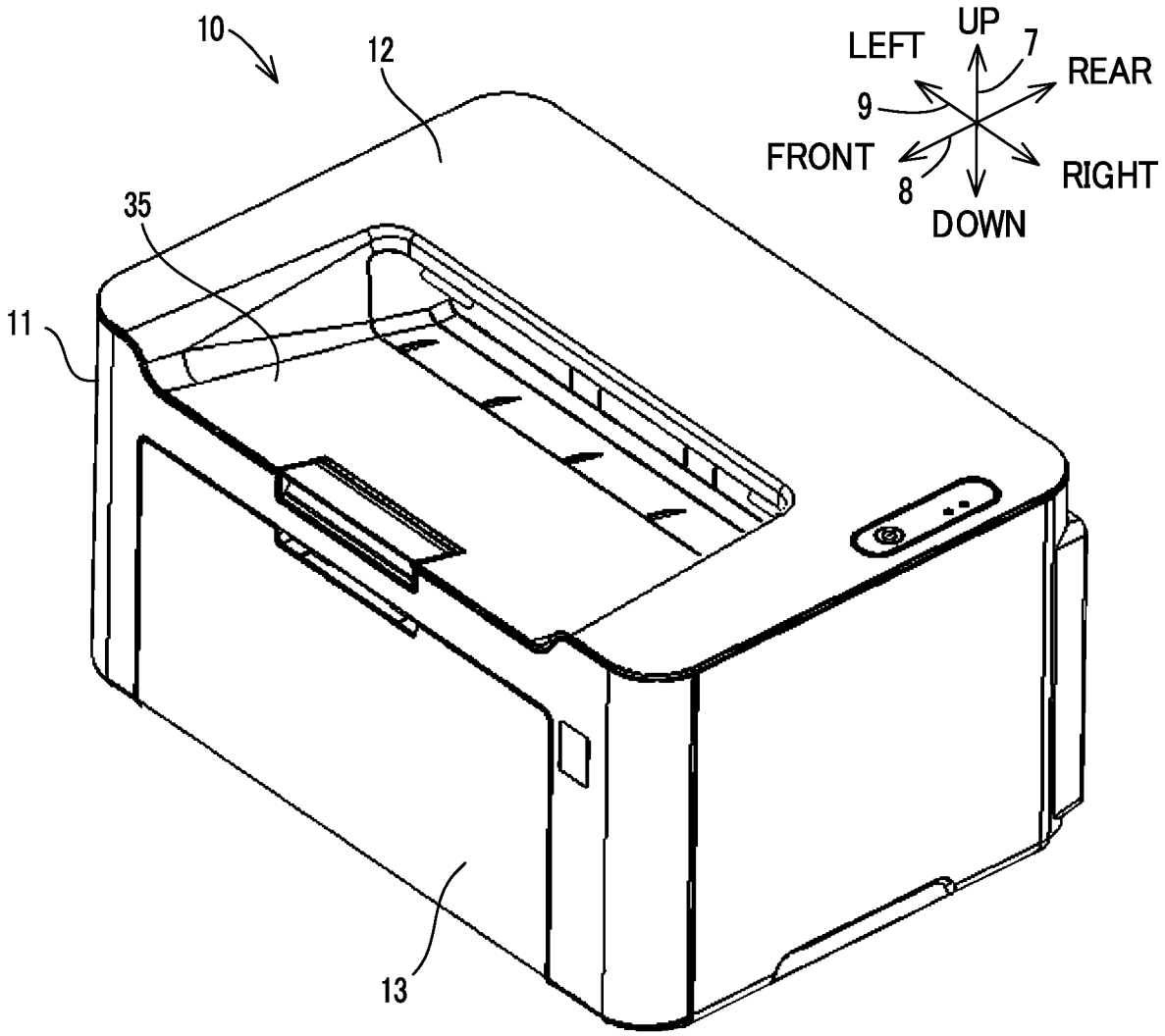
FIG. 1 is a perspective view of an image forming apparatus according to an embodiment of the present disclosure.

The following describes embodiments of the present disclosure with reference to the accompanying drawings. It should be noted that the following embodiments are examples of specific embodiments of the present disclosure and should not limit the technical scope of the present disclosure. In the description below, an up-down direction 7, a front-rear direction 8, and a left-right direction 9 in the drawings are used for purposes of illustration. In FIGS. 1 to 5, the vertical direction in a state where an image forming apparatus 10 is installed and ready for use (state shown in FIG. 1) is defined as the up-down direction 7, and the front-rear direction 8 and the left-right direction 9 (width direction 9) are defined relative to the installed state.

Figure 2:
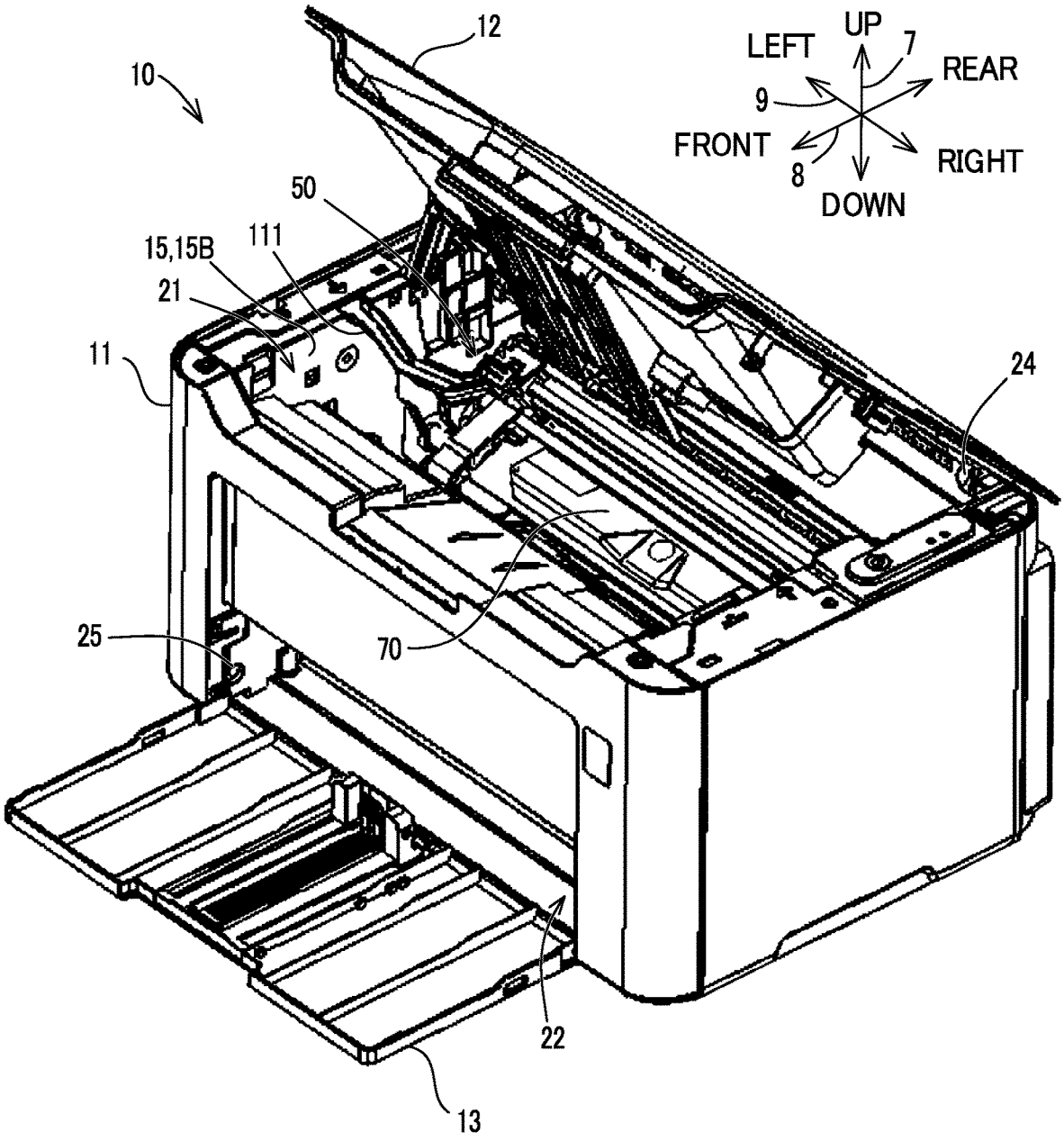
FIG. 2 is a perspective view of the image forming apparatus according to the embodiment of the present disclosure with its top cover open.
Figure 3:
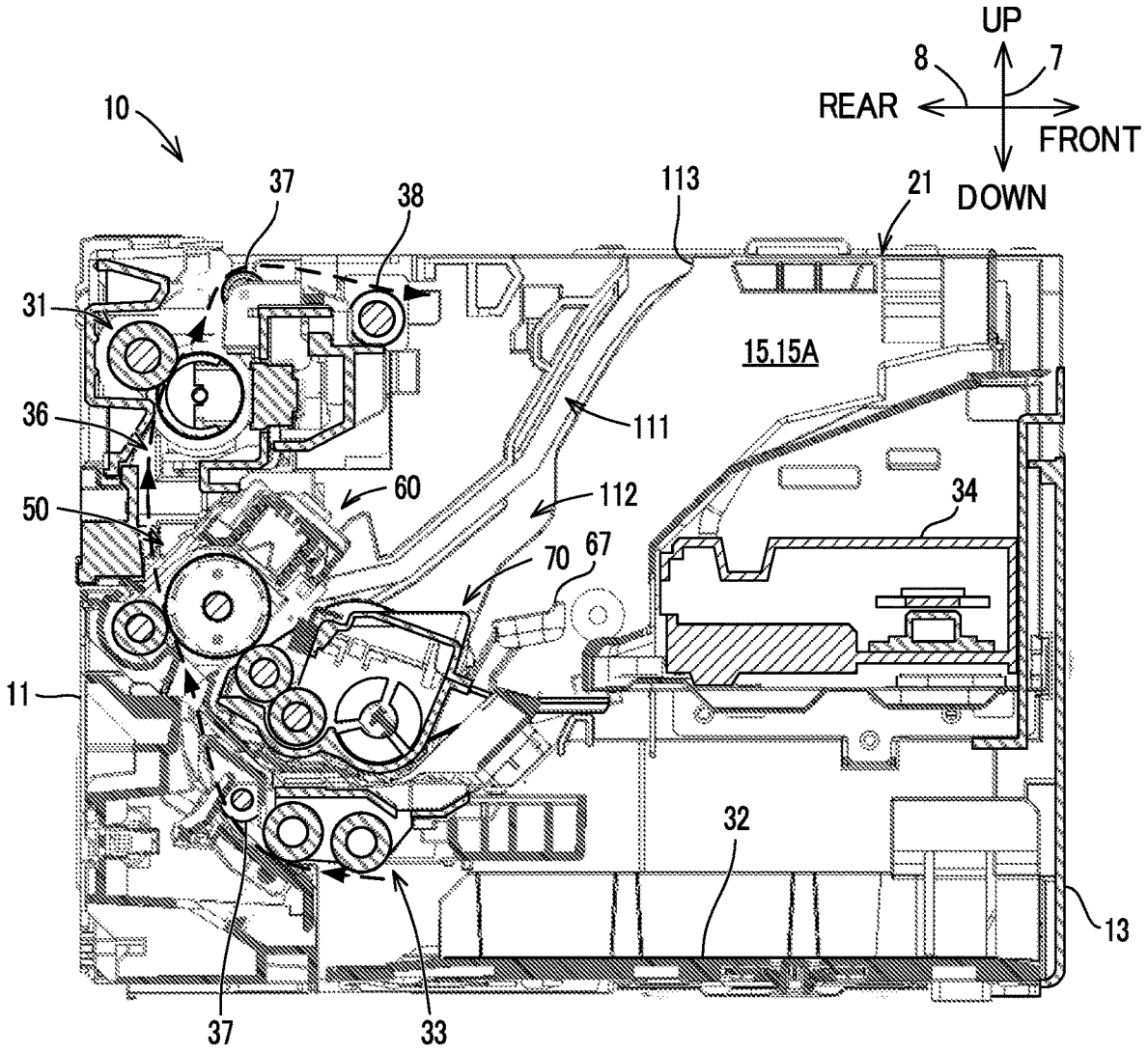
FIG. 3 is a cross-sectional view showing the configuration inside the image forming apparatus according to the embodiment of the present disclosure.

FIGS. 1 to 3 show the image forming apparatus 10 according to an embodiment of the present disclosure. The image forming apparatus 10 is provided with at least a print function and is, for example, a printer that forms monochrome images on sheets such as printing sheets by an electrophotographic method. The image forming apparatus 10 prints images on printing sheets on the basis of image data input from the outside through a communication portion (not shown). It is noted that the image forming apparatus 10 is not limited to a monochrome printer but may be a color printer that forms color images. In addition, the image forming apparatus 10 may be a multifunction peripheral such as a facsimile or a copier having other functions in addition to the print function.

FIGS. 1 and 2 are perspective views showing the external appearance of the image forming apparatus 10. In FIG. 1, a top cover 12 and a front cover 13 are closed, whereas the top cover 12 and the front cover 13 are open in FIG. 2. FIG. 3 is a cross-sectional view showing the configuration inside an apparatus body 11. It is noted that the top cover 12 is not shown in FIG. 3.

As shown in FIGS. 1 and 2, the image forming apparatus 10 has a substantially rectangular parallelepiped shape elongated in the width direction 9. The image forming apparatus 10 includes the apparatus body 11 in which various components that perform an image formation process are installed, the top cover 12 disposed in an upper part of the apparatus body 11, and the front cover 13 disposed on the front face of the apparatus body 11.

As shown in FIG. 2, the apparatus body 11 has an opening 21 in the upper part. The opening 21 communicates with the inside and can be opened and closed by the top cover 12. The top cover 12 is supported by a hinge 24 disposed at the rear end in the upper part of the apparatus body 11 and opens and closes the opening 21 by changing its position between an open position (position shown in FIG. 2) in which the opening 21 is opened and a closed position (position shown in FIG. 1) in which the opening 21 is closed. When the top cover 12 pivots upward (opening direction) to open the opening 21, an image forming unit 50 (described later) and the like installed in the apparatus body 11 are exposed. In this state, users can take out a developing device 70 supported by the image forming unit 50 from inside the apparatus body 11.

In addition, the apparatus body 11 has an opening 22 in a lower part of the front face. The opening 22 communicates with the inside and can be opened and closed by the front cover 13. The front cover 13 is supported by a hinge 25 disposed at the lower end in the front of the apparatus body 11 and opens and closes the opening 22 by changing its position between an open position (position shown in FIG. 2) in which the opening 22 is opened and a closed position (position shown in FIG. 1) in which the opening 22 is closed. When the front cover 13 pivots forward (opening direction) to open the opening 22, printing sheets can be set inside the apparatus body 11 through the opening 22.

As shown in FIG. 3, the image forming apparatus 10 mainly includes the image forming unit 50, a fixing portion 31, a paper feed tray 32, a conveying unit 33, an LSU (Laser Scanner Unit) 34, a sheet discharge tray 35 (see FIG. 1), a plurality of conveying rollers 37 disposed on a conveyance path 36, and a discharge roller 38 disposed at the trailing end of the conveyance path 36. The components are installed inside the apparatus body 11 including outer frame covers and inner frames of the image forming apparatus 10. It is noted that the conveyance path 36 is indicated by broken lines extending upward from the conveying unit 33 in FIG. 3.

Figure 4:
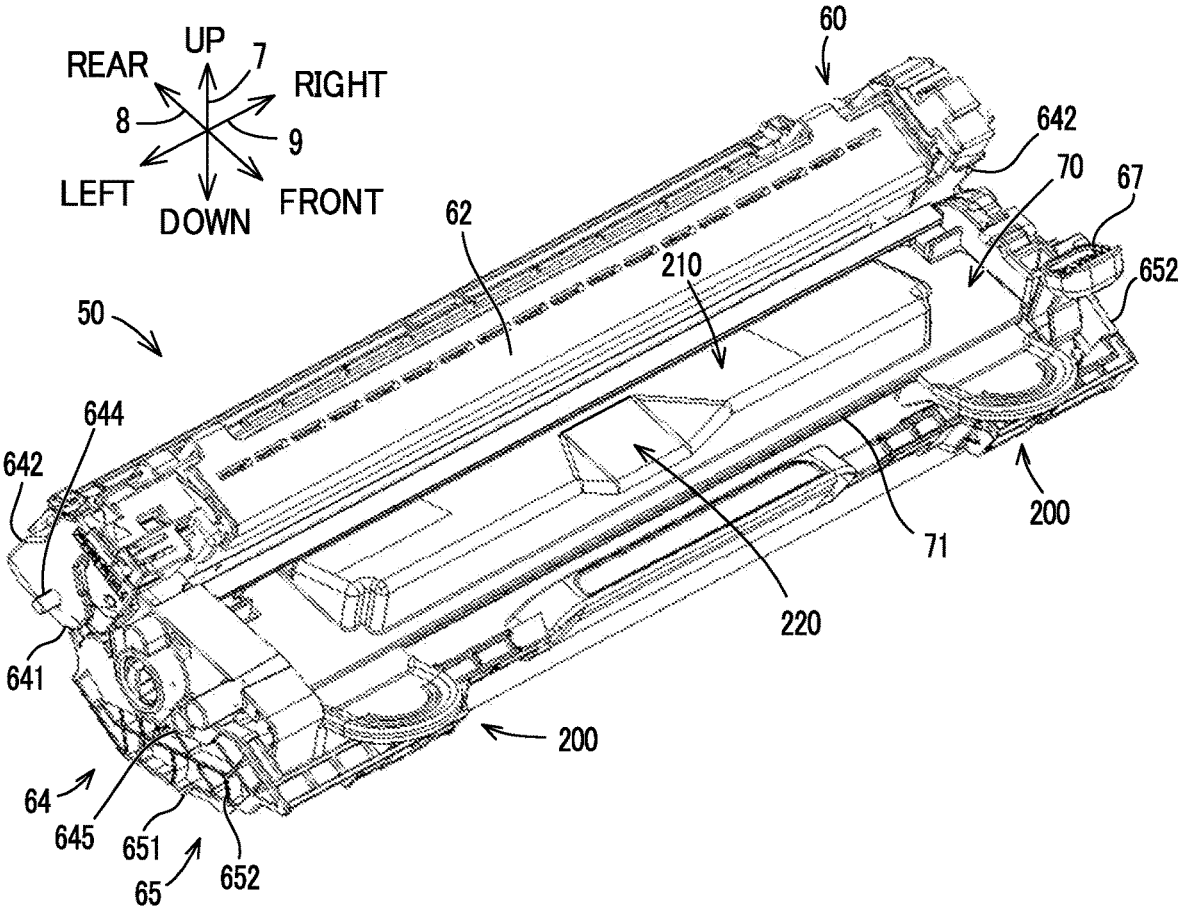
FIG. 4 is a perspective view of an image forming unit provided for the image forming apparatus according to the embodiment of the present disclosure.

FIG. 4 is a perspective view of the image forming unit 50. The image forming unit 50 is configured to form images by an electrophotographic method and includes a drum unit 60 and the developing device 70. In the present embodiment, the image forming unit 50 is detachably supported by the apparatus body 11 so as to be replaceable.

Figure 5:
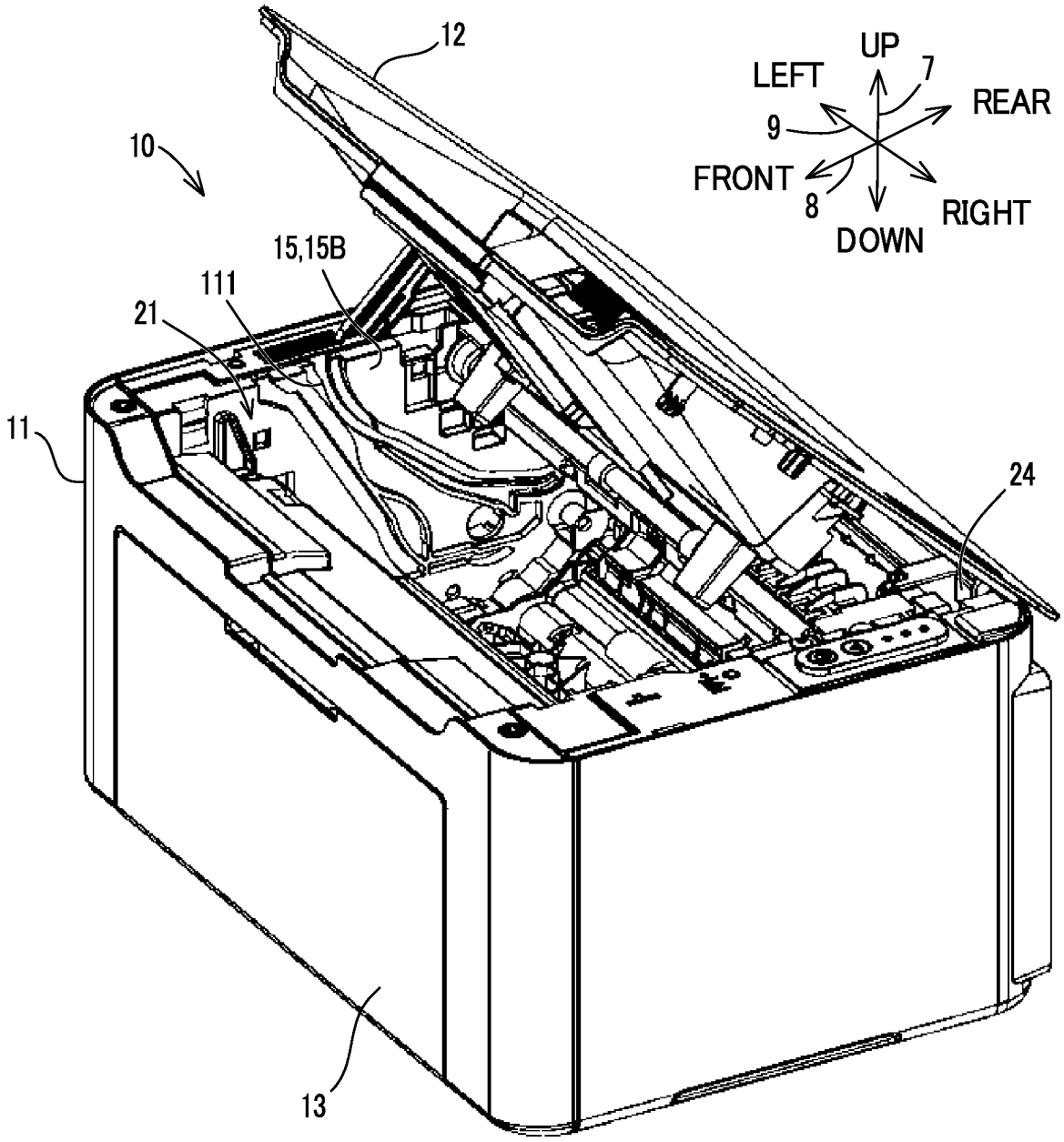
FIG. 5 is a perspective view of the image forming apparatus according to the embodiment of the present disclosure when the image forming unit is removed from an apparatus body.

When developer stored in the developing device 70 runs out, the developing device 70 needs to be replaced with another developing device 70 filled with developer. To achieve this, in the present embodiment, the developing device 70 is supported by the apparatus body 11 to be detachable from the apparatus body 11. Specifically, the developing device 70 is installed to be detachable from the drum unit 60 (an example of an installation member) installed in the apparatus body 11. It is noted that the developing device 70 is also removed for the maintenance of the inside of the image forming apparatus 10 when necessary. FIGS. 2 and 3 show the apparatus body 11 with the image forming unit 50 installed therein. FIG. 5 shows the apparatus body 11 from which the image forming unit 50 is removed.

Figure 6:
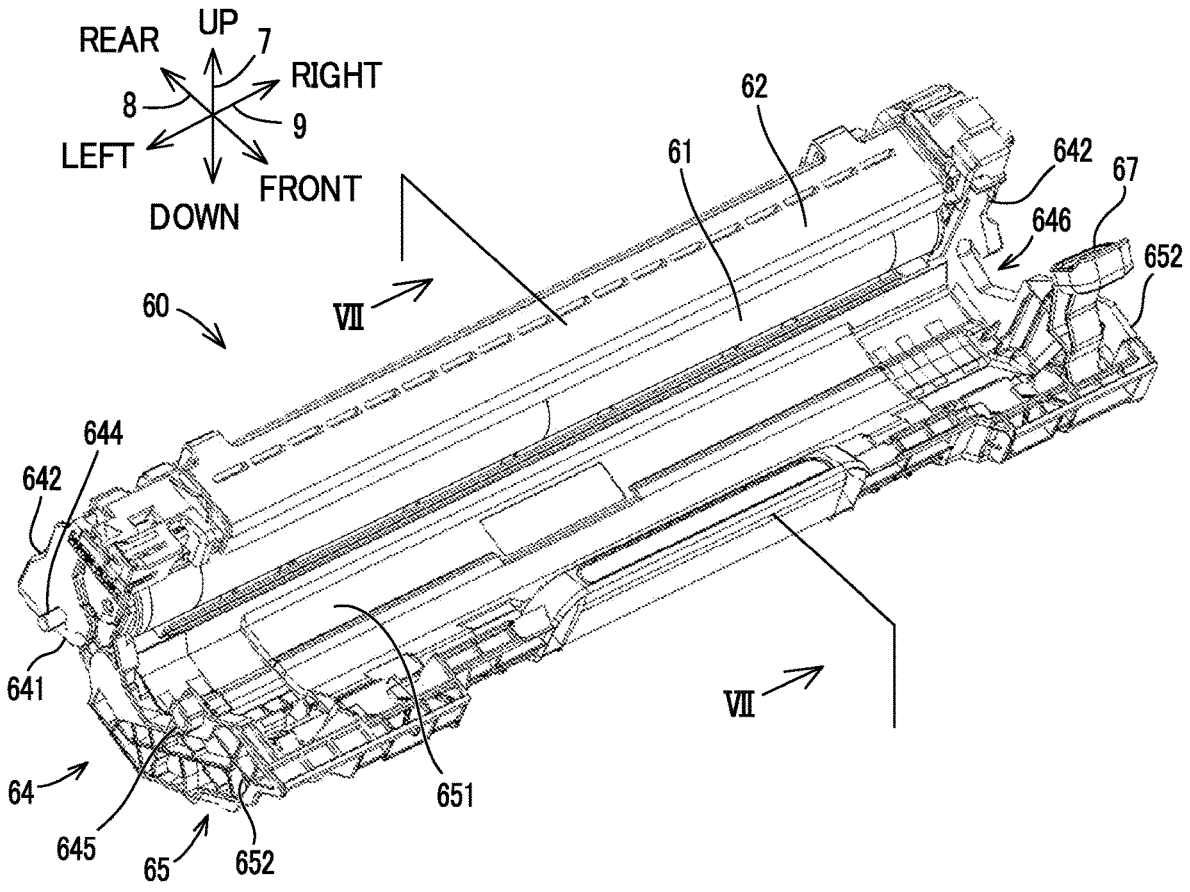
FIG. 6 is a perspective view of a drum unit provided for the image forming apparatus according to the embodiment of the present disclosure.
Figure 7:
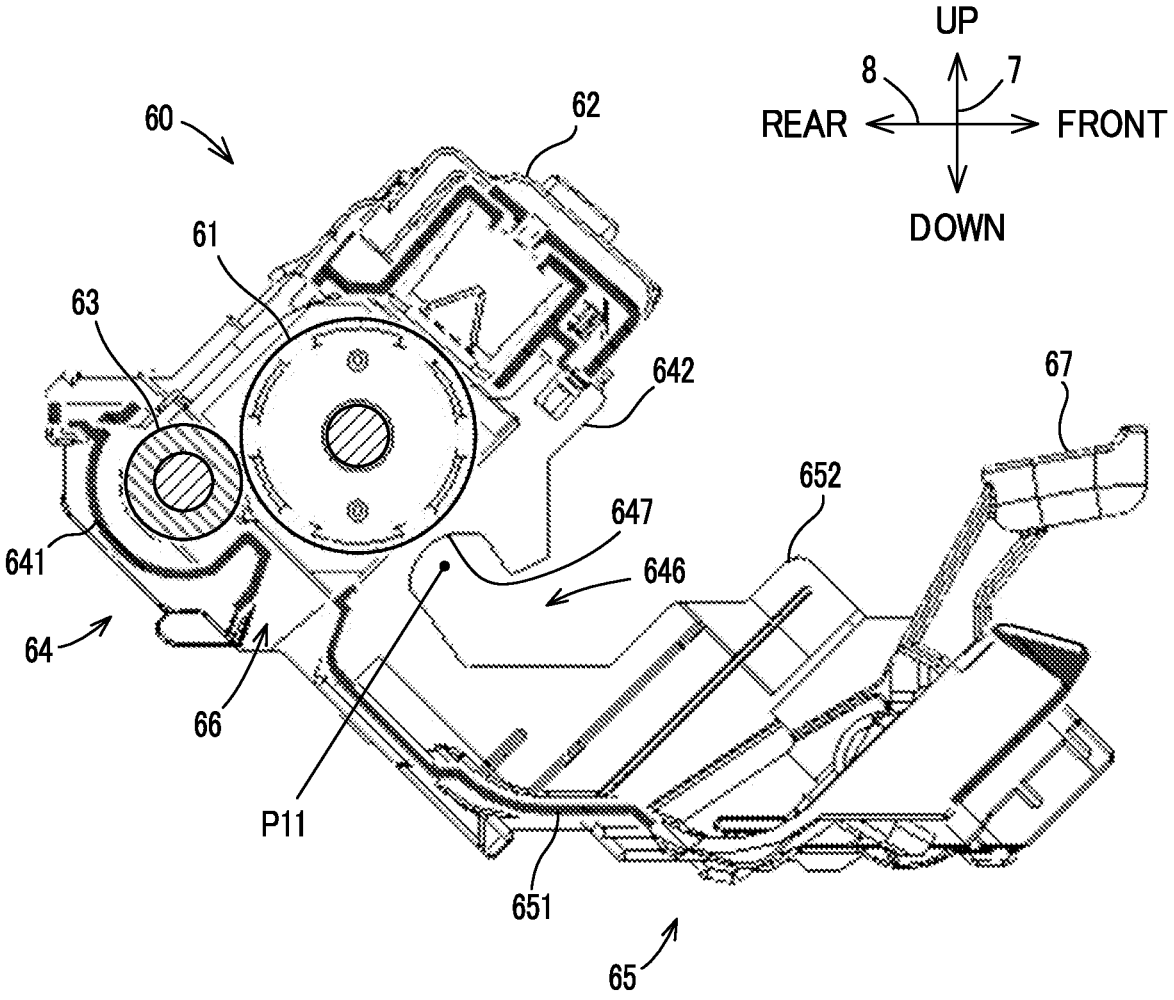
FIG. 7 is a cross-sectional view, taken along cutting plane VII-VII in FIG. 6, showing the configuration of the drum unit provided for the image forming apparatus according to the embodiment of the present disclosure in cross-section.

FIG. 6 is a perspective view of the drum unit 60. FIG. 7 is a cross-sectional view, taken along line VII-VII in FIG. 6, showing the configuration of the drum unit 60 in cross-section.

As shown in FIGS. 6 and 7, the drum unit 60 includes a photoconductor drum 61, a charging portion 62, a transfer roller 63, and a housing 64. The housing 64 supports the photoconductor drum 61, the charging portion 62, and the transfer roller 63. In addition, the developing device 70 is detachably supported by a developing-device support portion 65 integral to the housing 64.

The housing 64 is a molded part formed from, for example, synthetic resin and includes a first base frame 641 extending in the left-right direction 9 and a pair of support frames 642 each extending straight upward from left or right end of the first base frame 641. The support frames 642 have, for example, a thin, flat shape. The support frames 642 are composed of an insulating member that does not conduct electricity. The support frames 642 extend in the front-rear direction 8. The photoconductor drum 61 and the transfer roller 63 are rotatably supported in rear parts of the support frames 642 while being in pressure contact with each other. In addition, the charging portion 62 is attached to upper rear parts of the support frames 642. The charging portion 62 is attached to the support frames 642 to connect the support frames 642 while facing the outer peripheral surface of the photoconductor drum 61.

As shown in FIGS. 6 and 7, the developing-device support portion 65 is integral to a front part of the housing 64. The developing-device support portion 65 includes a second base frame 651 extending forward from the first base frame 641 with a paper feed slot 66 (see FIG. 7) therebetween and front plates 652 constituting front parts of the support frames 642. When the developing device 70 is installed in the developing-device support portion 65, the lower surface 716 (see FIG. 12) of the developing device 70 is supported by the second base frame 651. In this case, the lower surface 716 serves as a surface to be supported by the drum unit 60.

The paper feed slot 66 is a through-hole formed between the first base frame 641 and the second base frame 651 and guides a printing sheet fed from the paper feed tray 32 therethrough to a transfer position between the photoconductor drum 61 and the transfer roller 63.

When an image forming operation starts, in the image forming unit 50 installed in the apparatus body 11, the charging portion 62 uniformly charges a photosensitive layer on the surface of the photoconductor drum 61 to a predetermined potential. Then, the LSU 34 scans a laser beam based on image data over the photoconductor drum 61. This forms an electrostatic latent image on the surface of the photoconductor drum 61. Bias voltages are applied to the photoconductor drum 61 and a developing roller 74 (see FIG. 10) of the developing device 70 to create an electric field having a predetermined potential difference between the photoconductor drum 61 and the developing roller 74. This enables toner to move from the developing roller 74 to the photoconductor drum 61. The potential difference causes the toner on the developing roller 74 to adhere to the electrostatic latent image and thus forms a toner image on the photoconductor drum 61. An electric field having a predetermined potential difference is also created between the photoconductor drum 61 and the transfer roller 63. The potential difference causes the toner image on the photoconductor drum 61 to be transferred to a printing sheet fed from the paper feed tray 32. The printing sheet to which the toner image is transferred is conveyed to the fixing portion 31.

The fixing portion 31 is disposed downstream of the image forming unit 50 in a conveying direction of the printing sheet. The fixing portion 31 fixes the toner image transferred to the printing sheet onto the printing sheet by heat. The fixing portion 31 includes a heating roller and a pressure roller. The heating roller is heated by heating means such as an induction heater during a fixing operation. The pressure roller is biased to the heating roller by an elastic member. When the printing sheet passes through the fixing portion 31, toner is heated and fused onto the printing sheet while the printing sheet is pressed by the fixing portion 31. Thus, the toner image is fixed onto the printing sheet, and an image is formed on the printing sheet.

The discharge roller 38 is disposed downstream of the fixing portion 31 in the conveying direction. The discharge roller 38 discharges the printing sheet onto which the image is fixed by the fixing portion 31, that is, after image formation, to the sheet discharge tray 35 (see FIG. 1).

Figure 8:
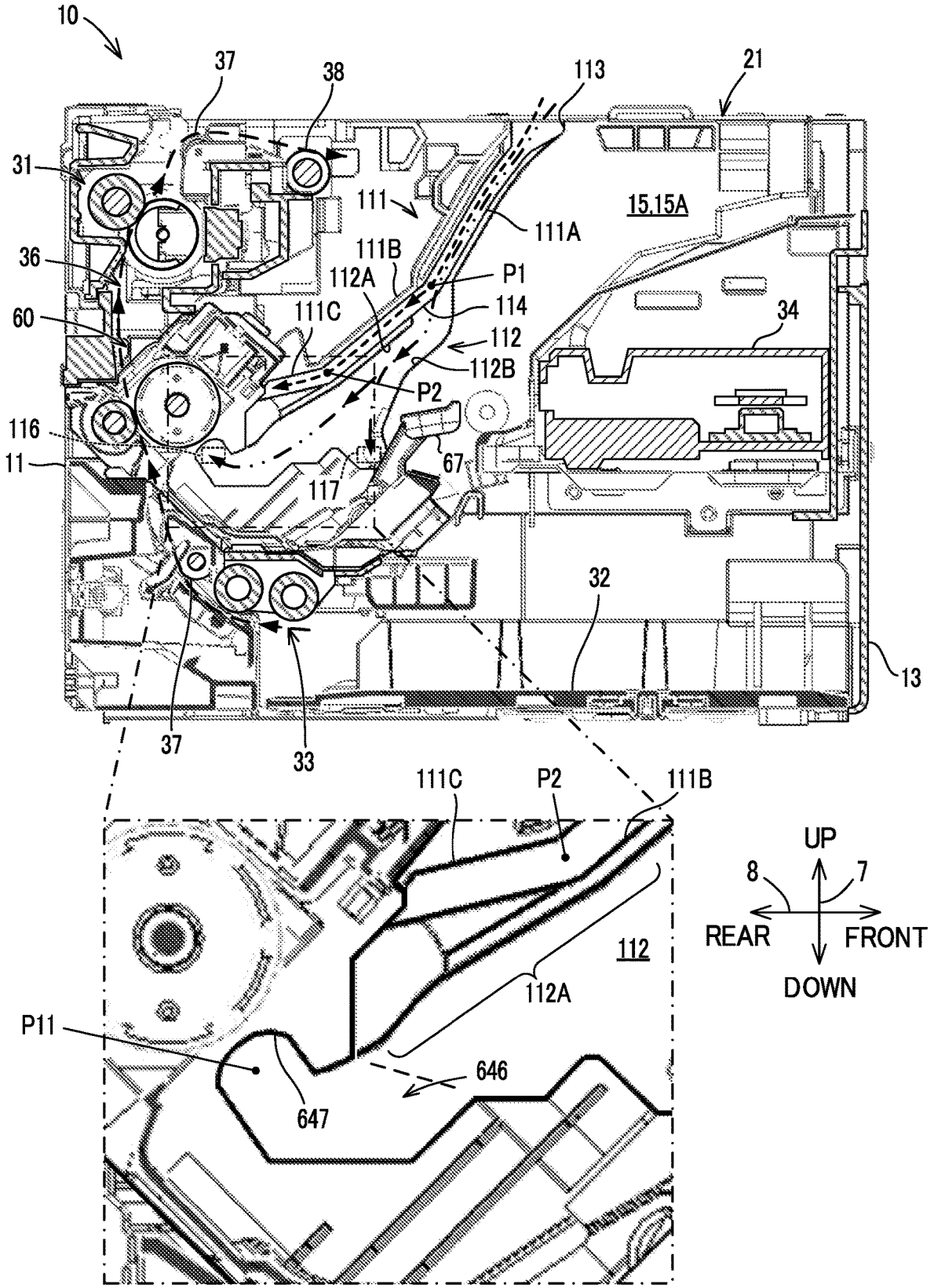
FIG. 8 is a cross-sectional view showing the configuration inside the image forming apparatus according to the embodiment of the present disclosure when the drum unit is installed in the apparatus body.

As more images are formed, the photosensitive layer on the surface of the photoconductor drum 61 of the drum unit 60 deteriorates and wears. Deterioration of the photosensitive layer prevents the photosensitive layer from being charged properly, and wear on the photosensitive layer prevents the photosensitive layer from being charged to a predetermined potential. As a result, the image quality degrades. Accordingly, the photoconductor drum 61 needs to be replaced at a predetermined timing of replacement. To achieve this, in the present embodiment, the drum unit 60 is supported by the apparatus body 11 to be detachable from the apparatus body 11 so that the photoconductor drum 61 can be replaced. In addition, the drum unit 60 is also removed for the maintenance of the inside of the image forming apparatus 10 when necessary. Here, FIG. 8 is a cross-sectional view showing a state where only the drum unit 60 of the image forming unit 50 is installed in the apparatus body 11. That is, the developing device 70 is not shown in FIG. 8.

As shown in FIG. 8, the apparatus body 11 has guide grooves 111 formed in inner surfaces 15 on both sides in the left-right direction 9. The guide grooves 111 guide the drum unit 60 when the drum unit 60 is installed into the apparatus body 11 through the opening 21. The guide grooves 111 also facilitate removal of the drum unit 60 from the apparatus body 11 by guiding the drum unit 60 to the opening 21. The guide grooves 111 extend obliquely downward and rearward from insertion openings 113 having a funnel shape when viewed in cross-section and formed in upper edge parts of the inner surfaces 15. It is noted that FIG. 8 shows only the guide groove 111 formed in the inner surface 15A on the right side. However, the guide groove 111 having a similar shape is also formed in the inner surface 15B (see FIG. 5) on the left side.

The inclination of the guide grooves 111 gradually decreases toward the installation position of the drum unit 60 (position shown in FIG. 8; hereinafter referred to as "unit installation position"). Specifically, the guide grooves 111 each include a first groove 111A extending substantially straight from the insertion opening 113 to a first inflection point P1, a second groove 111B extending from the first inflection point P1 to a second inflection point P2 at an inclination less than that of the first groove 111A, and a third groove 111C extending from the second inflection point P2 to the unit installation position at an inclination less than that of the second groove 111B.

As shown in FIG. 6, the drum unit 60 is provided with guide members 644 to be inserted into the guide grooves 111 when the drum unit 60 is installed in and removed from the apparatus body 11. The guide members 644 extend straight outward from the respective outer surfaces of the pair of support frames 642 constituting the housing 64. The guide members 644 have a boss shape or a pin shape extending perpendicular to the outer surfaces of the support frames 642.

The guide members 644 are disposed in rear parts on the outer surfaces of the support frames 642. The drum unit 60 is inserted until the guide members 644 are disposed at the ends of the guide grooves 111.

As shown in FIG. 8, another guide groove 112 branches off from the guide groove 111 in the inner surface 15A. FIG. 8 shows only the guide groove 112 formed in the inner surface 15A on the right side. However, a similar guide groove 112 is also formed in the inner surface 15B on the left side. As do the guide grooves 111, the guide grooves 112 guide the drum unit 60 to the unit installation position when the drum unit 60 is installed into the apparatus body 11 through the opening 21, and guide the drum unit 60 to the opening 21 when the drum unit 60 is removed from the apparatus body 11.

The guide grooves 112 extend obliquely downward and rearward from the first inflection points P1 in the guide grooves 111. The guide grooves 112 gradually widen obliquely rearward from upper end openings 114 serving as connection points between the guide grooves 112 and the guide grooves 111. In other words, the guide grooves 112 have a substantially divergent shape broadening obliquely rearward from the upper end openings 114.

The upper wall surfaces of the guide grooves 112 are guide surfaces 112A for guiding bearing portions 77 (described later; see FIGS. 13 and 15) provided for the developing device 70 to installation positions P11 defined on the drum unit 60 when the developing device 70 is installed in the apparatus body 11. The guide surfaces 112A are substantially parallel to the second grooves 111B of the guide grooves 111.

In addition, the lower wall surfaces of the guide grooves 112 are guide surfaces 112B for guiding guide members 645 (described later; see FIG. 6) provided for the drum unit 60 downward when the drum unit 60 is installed in the apparatus body 11. In addition, the guide surfaces 112B guide guide portions 78 and 791 (described later; see FIGS. 13 and 15) provided for the developing device 70 downward when the developing device 70 is installed in the apparatus body 11.

As shown in FIG. 6, the drum unit 60 is provided with the guide members 645 to be inserted into the guide grooves 112 when the drum unit 60 is installed in and removed from the apparatus body 11. The guide members 645 extend straight outward from the respective outer surfaces of the pair of support frames 642 constituting the housing 64. The guide members 645 have a boss shape or a pin shape extending perpendicular to the outer surfaces of the support frames 642.

The guide members 645 are disposed on the outer surfaces of the support frames 642 to be closer to the front than the guide members 644. When the drum unit 60 is installed in the apparatus body 11, first, the guide members 644 are inserted into the guide grooves 111 from the insertion openings 113. Subsequently, the guide member 645 are inserted into the guide grooves 111. During the installation of the drum unit 60, the guide members 644 are guided from the first grooves 111A to the unit installation position (position shown in FIG. 8) through the second grooves 111B along the third grooves 111C. On the other hand, during the installation of the drum unit 60, the guide member 645 enter the guide grooves 112 from the upper end openings 114 upon reaching the first inflection points P1 on the guide grooves 111, and are guided substantially downward along the guide surfaces 112B of the guide grooves 112.

When the drum unit 60 is inserted until it reaches the unit installation position shown in FIG. 8, a locking mechanism (not shown) locks the drum unit 60 at the unit installation position. That is, the drum unit 60 is positioned at the unit installation position. It is noted that the engagement by the locking mechanism is released by operating an unlocking member (not shown) provided for the apparatus body 11. This allows the drum unit 60 to be detached upward from the unit installation position and taken out to the outside through the opening 21.

In addition, as shown in FIG. 7, the support frames 642 each have a guide groove 646 for guiding the corresponding bearing portion 77 (see FIGS. 13 and 15) of the developing device 70 to the installation position P11 and a stopper 647 disposed at the end of the guide groove 646. The guide grooves 646 are formed in the support frames 642 to divide the support frames 642 into the rear parts and the front plate 652. When the bearing portions 77 are guided to the installation positions P11, the stoppers 647 position the bearing portions 77 at the installation positions P11. When the developing device 70 is installed in the apparatus body 11, the stoppers 647 abut on the bearing portions 77 and prevent the movement of the bearing portions 77 in a direction of insertion. Thus, the developing device 70 is positioned on the drum unit 60. In addition, the developing device 70 is locked to the drum unit 60 by the locking mechanism (not shown) provided for the drum unit 60. It is noted that the engagement by the locking mechanism is released by operating an unlocking lever 67 provided for the drum unit 60. This allows the developing device 70 to be detached upward from the apparatus body 11 and taken out to the outside through the opening 21.

Figure 9:
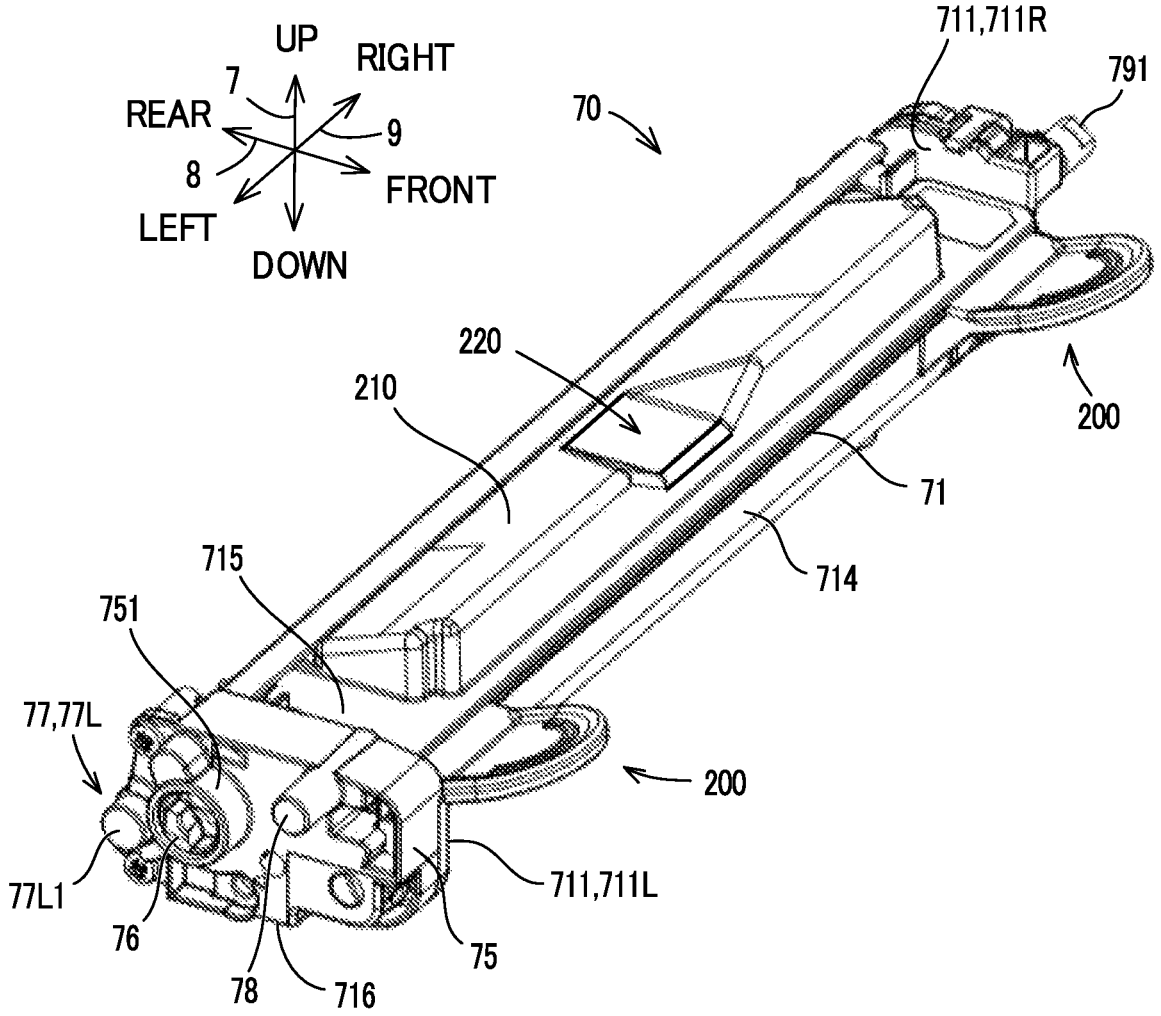
FIG. 9 is a perspective view of a developing device according to the embodiment of the present disclosure viewed from the left front.
Figure 10:
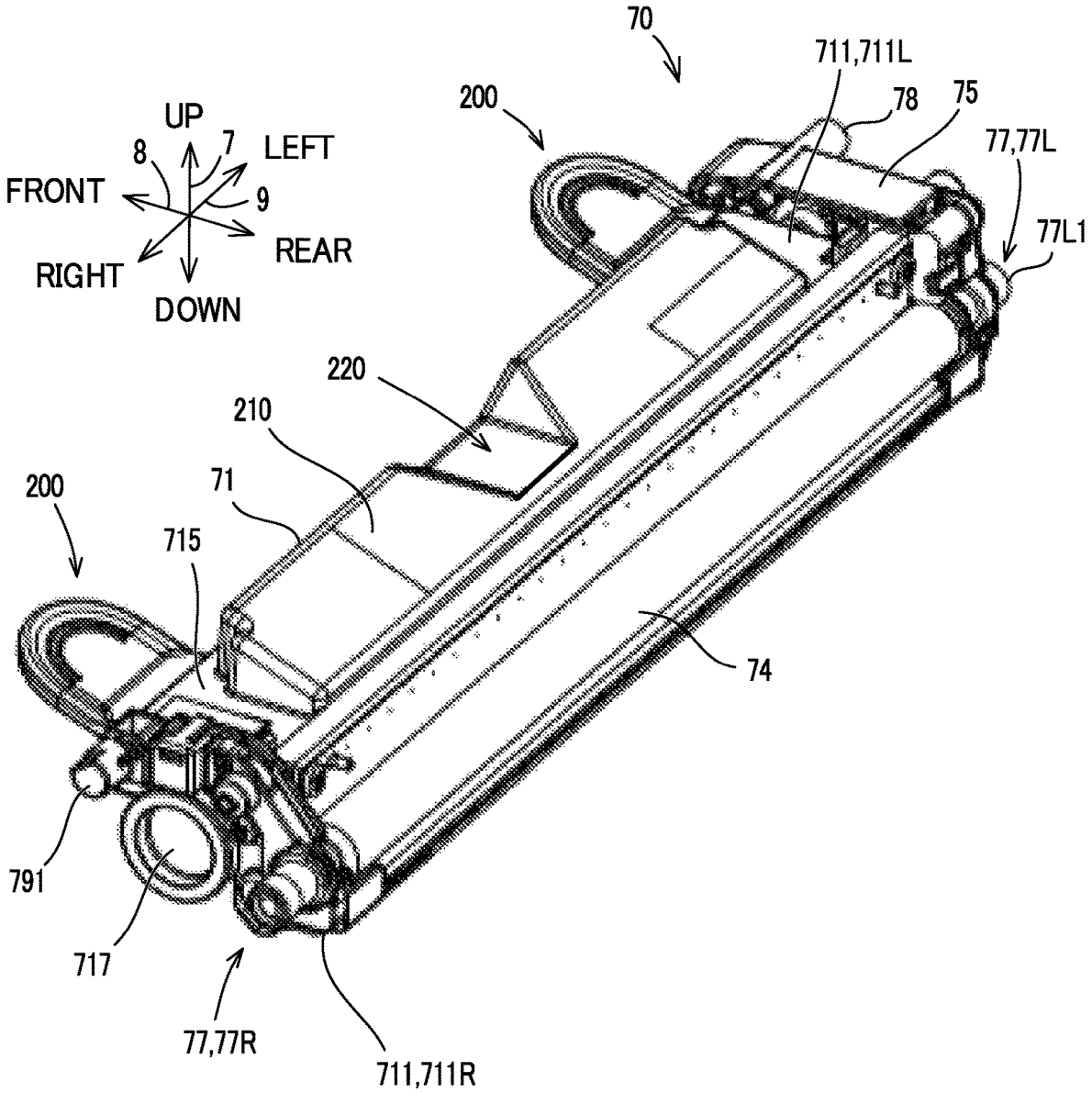
FIG. 10 is a perspective view of the developing device according to the embodiment of the present disclosure viewed from the right rear.
Figure 11:
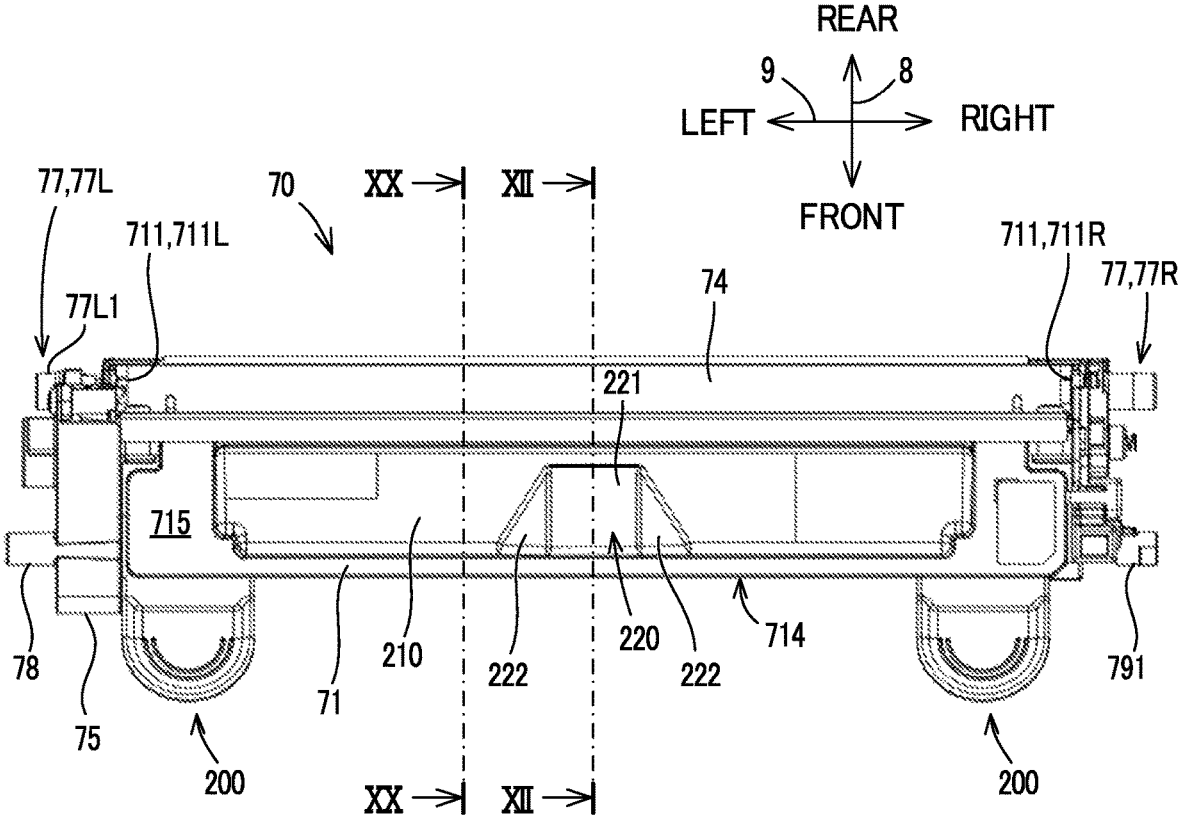
FIG. 11 is a plan view of the developing device according to the embodiment of the present disclosure.
Figure 12:
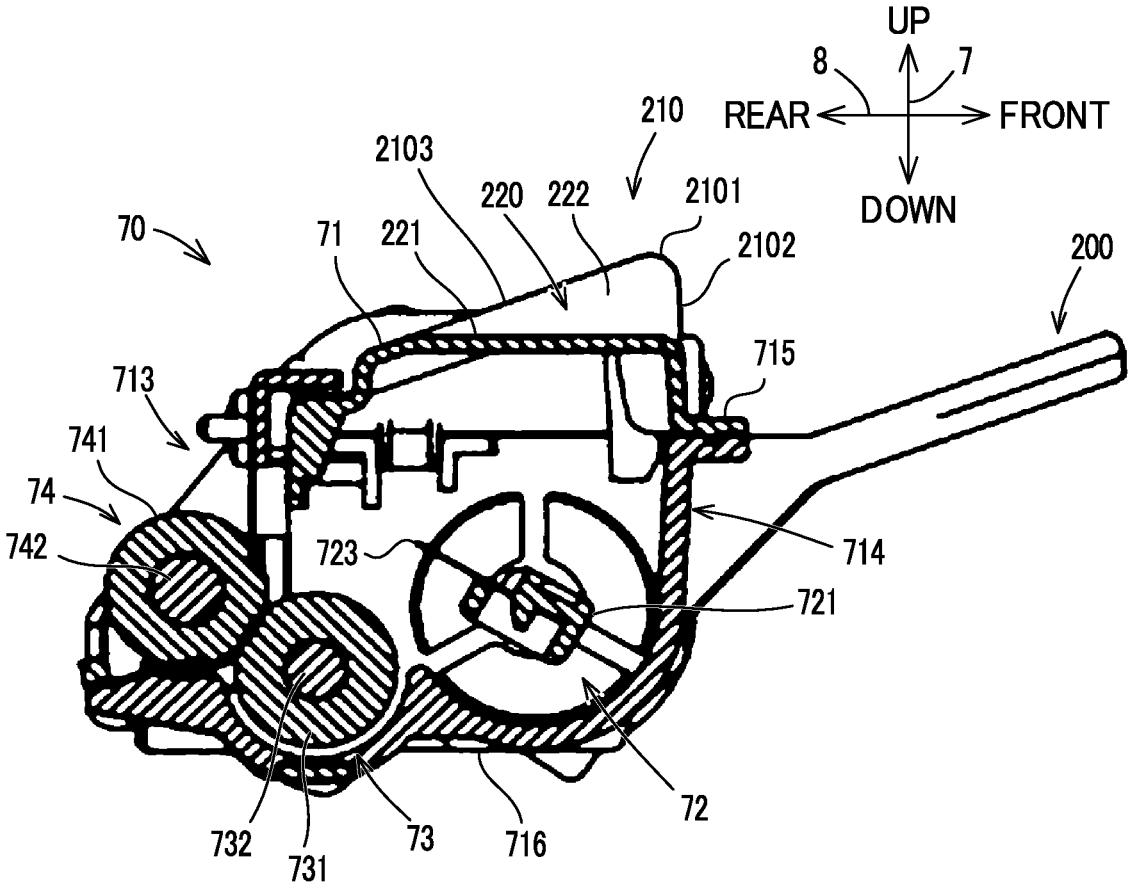
FIG. 12 is a cross-sectional view, taken along cutting plane XII-XII in FIG. 11, showing the configuration inside the developing device according to the embodiment of the present disclosure.

FIG. 9 is a perspective view of the developing device 70 viewed from the left front. FIG. 10 is a perspective view of the developing device 70 viewed from the right rear. FIG. 11 is a plan view of the developing device 70. FIG. 12 is a cross-sectional view, taken along cutting plane XII-XII in FIG. 11, showing the configuration of the middle part of the developing device 70 in cross-section.

The developing device 70 causes toner to adhere to an electrostatic latent image on the photoconductor drum 61 to develop the electrostatic latent image using the toner. This forms a toner image serving as a visible image on the surface of the photoconductor drum 61. As shown in FIG. 12, the developing device 70 includes a housing 71 (an example of a housing), a stirring member 72, a supply roller 73 (an example of a rotating member), and the developing roller 74 (an example of the rotating member). The stirring member 72, the supply roller 73, and the developing roller 74 are rotatably supported by the housing 71.

The housing 71 is a molded part formed from, for example, synthetic resin. As shown in FIGS. 9 to 11, the housing 71 is elongated in the left-right direction 9 (longitudinal direction). The housing 71 stores therein developer that contains toner. That is, the housing 71 functions as a developer container (also referred to as "toner container") as well as the housing that supports the developing roller 74 and the like.

As shown in FIG. 12, the stirring member 72 is disposed in a front part inside the housing 71. The stirring member 72 is rotatably supported by a pair of support frames 711 (see FIGS. 9 to 11) each disposed on either side of the housing 71 in the left-right direction 9 (axial direction). It is noted that the pair of support frames 711 (an example of a pair of support members) each constitute a side face on either side of the housing 71 in the left-right direction 9.

Figure 14:
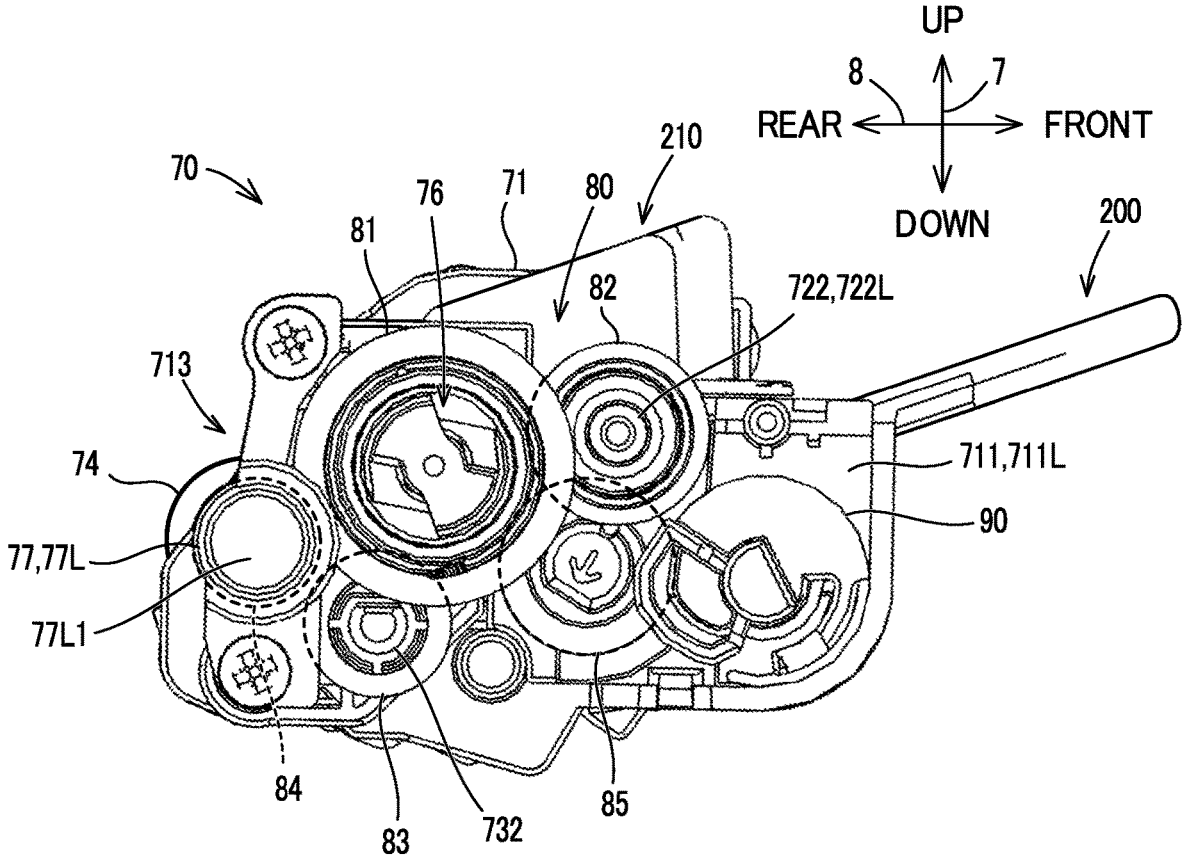
FIG. 14 is a left side view of the developing device according to the embodiment of the present disclosure with its side cover removed.

A support shaft 722 (see FIG. 14) rotatably supported by the corresponding support frame 711 is disposed on either end of a shaft member 721 of the stirring member 72 in the width direction. The left support shaft 722L of the stirring member 72 is rotatably supported by a bearing bore (not shown) formed in the left support frame 711L. As shown in FIG. 14, the support shaft 722L passes through the bearing bore and protrudes to the outside of the support frame 711L. A transmission gear 82 (described later) is attached to the support shaft 722L.

As shown in FIG. 12, the shaft member 721 of the stirring member 72 is provided with a film-like paddle portion 723 perpendicular to the shaft member 721. When a rotational driving force is input to the stirring member 72, the stirring member 72 rotates, and thereby the developer stored in the housing 71 is stirred by the paddle portion 723. As the developer is stirred by the stirring member 72, the toner contained in the developer is electrically charged.

As shown in FIG. 9, a side cover 75 is attached to the left support frame 711L of the housing 71.

Figure 13:
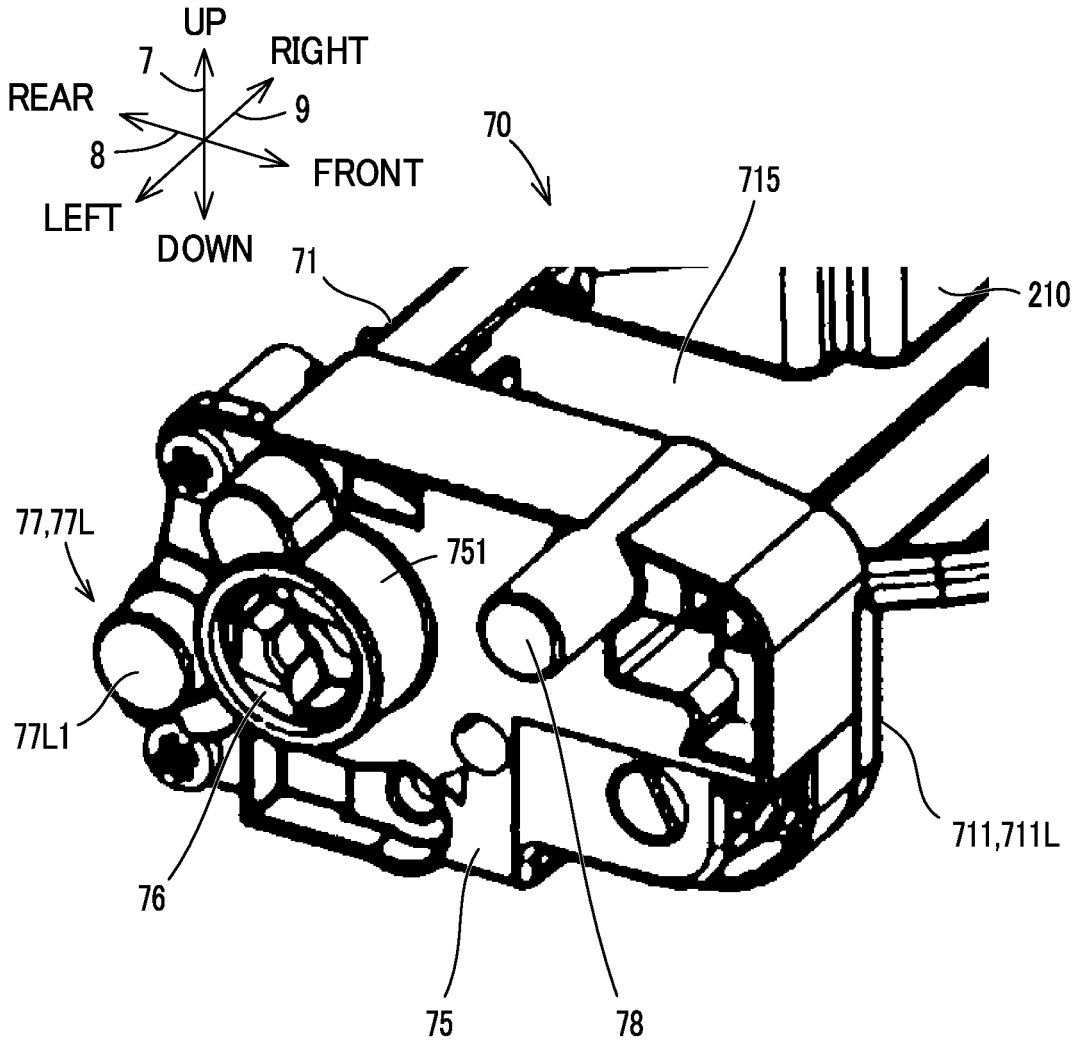
FIG. 13 is a partial enlarged view of a left part of the developing device according to the embodiment of the present disclosure.

FIG. 13 is a partial enlarged view of a left part of the developing device 70. FIG. 14 is a left side view of the developing device 70 from which the side cover 75 is removed.

As shown in FIG. 13, the side cover 75 is attached to the support frame 711L to cover the left face of the support frame 711L. As shown in FIG. 14, a transmission mechanism 80 composed of a plurality of gears 81 to 85 is disposed inside the side cover 75, that is, in a gap between the side cover 75 and the support frame 711L. The gears 81 to 85 constituting the transmission mechanism 80 are rotatably supported by the support frame 711L.

As shown in FIG. 14, the transmission mechanism 80 includes an input portion 76 to which a driving force is input from the outside. That is, the input portion 76 is provided for the support frame 711L. The input portion 76 is, for example, a shat coupling. The side cover 75 includes a cylindrical tubular portion 751 (see FIG. 13) through which the input portion 76 passes to be exposed to the outside. As shown in FIG. 13, when the side cover 75 is attached to the support frame 711L, the input portion 76 is exposed to the outside through the tubular portion 751.

When the developing device 70 is installed in the apparatus body 11, a driving-force output portion (not shown) provided for the apparatus body 11 is connected to the input portion 76. This enables the rotational driving force of a driving source such as a motor to be input to the input portion 76 through the driving-force output portion. The input portion 76 includes an input gear 81 (see FIG. 14) disposed to be coaxial to the input portion 76. That is, the transmission mechanism 80 includes the input gear 81. When the rotational driving force is input to the input portion 76, the rotational driving force is transmitted from the input gear 81 to the other transmission gears 82 to 85 constituting the transmission mechanism 80.

As shown in FIG. 14, the transmission mechanism 80 includes the plurality of transmission gears 82 to 85. The transmission gears 82 to 85 are disposed on the outer surface of the support frame 711L. The transmission gear 82 is attached to the support shaft 722L of the stirring member 72 to transmit the rotational driving force to the stirring member 72. The transmission gear 83 is attached to an end of a rotation shaft 732 (an example of a second support shaft) of the supply roller 73 to transmit the rotational driving force to the supply roller 73. The transmission gear 84 is attached to an end of a rotation shaft 742 (see FIG. 12) of the developing roller 74 to transmit the rotational driving force to the developing roller 74. In addition, the transmission gear 85 is rotatably supported by the support frame 711L while meshing with the transmission gear 82. The transmission gear 85 transmits the rotational driving force to a rotating member 90 disposed on the support frame 711L.

When the rotational driving force is input to the input portion 76 and transmitted from the input gear 81 to the other transmission gears 82 to 85 constituting the transmission mechanism 80, the rotational driving force is transmitted to the stirring member 72, the supply roller 73, the developing roller 74, and the rotating member 90, and thereby the stirring member 72, the supply roller 73, the developing roller 74, and the rotating member 90 rotate.

As shown in FIG. 12, the supply roller 73 is disposed in front (away in a direction opposite to that along which the developing device 70 is inserted) of the developing roller 74 and behind the stirring member 72. The supply roller 73 is a roller member that rotates while carrying toner contained in the developer on the outer peripheral surface thereof. The supply roller 73 is rotatably supported by the pair of support frames 711. The supply roller 73 rotates to convey the developer stored in the housing 71 to a position facing the developing roller 74 by carrying the developer on the outer peripheral surface thereof.

The supply roller 73 includes a cylindrical roller body 731 composed of an elastic member having electrical conductivity and the rotation shaft 732 having electrical conductivity and disposed in the center of the roller body 731. For example, the roller body 731 is composed of an elastic member such as urethane in which carbon is moderately dispersed. The rotation shaft 732 is a metal shaft having electrical conductivity. The ends of the rotation shaft 732 are rotatably supported by bearing bores (not shown) formed in the pair of support frames 711. A predetermined bias (hereinafter referred to as "supply bias") is applied to the supply roller 73 so that the supply roller 73 can carry toner on the outer peripheral surface thereof and that the toner can move from the supply roller 73 to the developing roller 74.

In the present embodiment, the supply bias is applied from a supply terminal 117 (see FIG. 8) provided for the apparatus body 11 to the rotation shaft 732 of the supply roller 73 while the developing device 70 is installed in the apparatus body 11. Specifically, the supply terminal 117 is disposed at a position where the supply terminal 117 is in contact with the guide portion 791 (described later; see FIGS. 15 and 16) when the developing device 70 is in an installed state. When the developing device 70 is installed in the apparatus body 11, the guide portion 791 comes into contact with the supply terminal 117, and thereby the supply bias is applied from the supply terminal 117 to the rotation shaft 732 through the guide portion 791, a guide member 79, and a connection portion 792.

The developing roller 74 is disposed in a rear part inside the housing 71. The developing roller 74 is a roller member that rotates while carrying the toner contained in the developer on the outer peripheral surface thereof. The developing roller 74 is rotatably supported by the pair of support frames 711. The housing 71 has an opening 713 in the rear face thereof. The developing roller 74 is exposed to the outside through the opening 713. When the developing device 70 is installed in the apparatus body 11, the developing roller 74 faces the photoconductor drum 61 with a predetermined gap therebetween.

The developing roller 74 includes a cylindrical roller body 741 composed of an elastic member having electrical conductivity and the rotation shaft 742 (an example of a first support shaft) having electrical conductivity and disposed in the center of the roller body 741. For example, the roller body 741 is composed of an elastic member such as urethane in which carbon is moderately dispersed. The rotation shaft 742 is a metal shaft having electrical conductivity. The ends of the rotation shaft 742 are rotatably supported by the bearing portions 77 (77L, 77R) provided for the pair of support frames 711 (see FIG. 11). A predetermined bias (hereinafter referred to as "developing bias") is applied to the developing roller 74 so that the toner can move from the supply roller 73 to the developing roller 74. The potential difference between the developing bias and the supply bias causes the electrically charged toner to be supplied from the supply roller 73 to the developing roller 74.

In the present embodiment, the developing bias is applied from a supply terminal 116 (see FIG. 8) provided for the apparatus body 11 to the rotation shaft 742 of the developing roller 74 while the developing device 70 is installed in the apparatus body 11. Specifically, the supply terminal 116 is disposed at a position where the supply terminal 116 is in contact with the bearing portion 77R (described later; see FIG. 15) when the developing device 70 is in the installed state. When the developing device 70 is installed in the apparatus body 11, a guide portion 77R2 (see FIG. 15) of the bearing portion 77R comes into contact with the supply terminal 116, and thereby the developing bias is applied from the supply terminal 116 to the rotation shaft 742 through the guide portion 77R2.

As shown in FIG. 14, the bearing portion 77L (an example of a first bearing portion) is provided for the support frame 711L. The bearing portion 77L is integral to the support frame 711L and includes a cylindrical guide portion 77L1 (an example of a first guide portion) protruding outward from the outer surface of the support frame 711L. The bearing portion 77L has therein a bearing bore in which the left shaft end of the rotation shaft 742 is fitted. Thus, the shaft end is rotatably supported. In the present embodiment, the guide portion 77L1 of the bearing portion 77L and the guide portion 77R2 of the bearing portion 77R (described later) also function as guide members for guiding the developing device 70 to the installation positions P11 defined on the drum unit 60 during the installation of the developing device 70 in the apparatus body 11.

As shown in FIG. 13, the side cover 75 is provided with the guide portion 78 integral to the side cover 75. The guide portion 78 is disposed in front (away in the direction opposite to that along which the developing device 70 is inserted) of (the guide portion 77L1 of) the bearing portion 77L at a predetermined distance. The guide portion 78 is a cylindrical member protruding outward from the outer surface of the side cover 75. In the present embodiment, the guide portion 78 and the guide portion 791 of the guide member 79 (described later) guide the front end part of the developing device 70 downward during the installation of the developing device 70 in the apparatus body 11.

Figure 15:
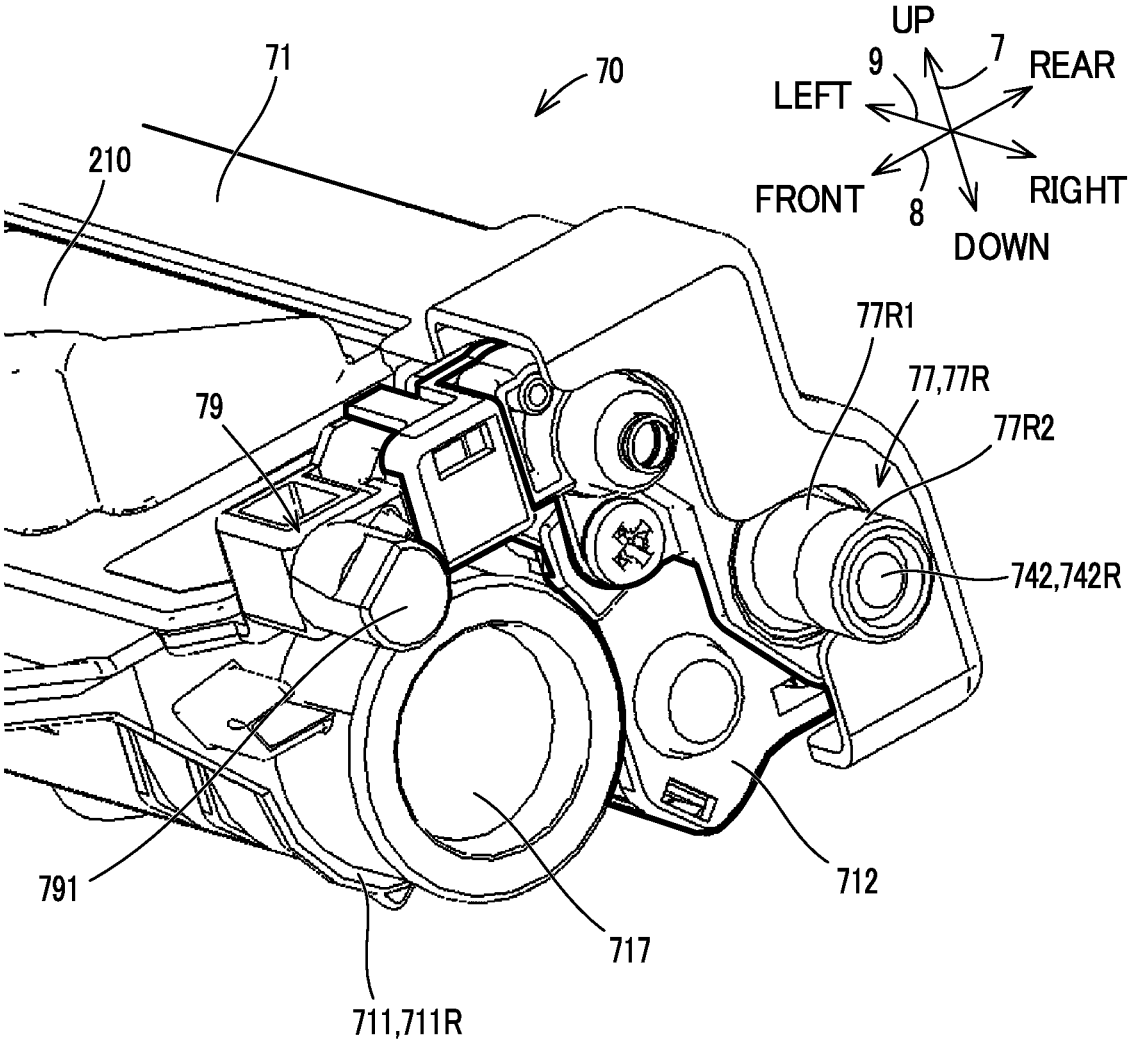
FIG. 15 is a partial enlarged perspective view of a right part of the developing device according to the embodiment of the present disclosure.

FIG. 15 is an enlarged perspective view of a right part of the developing device 70.

As shown in FIG. 15, the bearing portion 77R (an example of the first bearing portion) is provided for the support frame 711R. The bearing portion 77R includes a cylindrical portion 77R1 integral to the support frame 711R and the guide portion 77R2 (an example of the first guide portion) to be guided during the installation of the developing device 70 in the apparatus body 11. The cylindrical portion 77R1 protrudes outward from the outer surface of the support frame 711R. The cylindrical portion 77R1 has therein a hole in which the right shaft end 742R of the rotation shaft 742 is fitted. Thus, the shaft end 742R is rotatably supported.

When the rotation shaft 742 is placed through the cylindrical portion 77R1, the shaft end 742R passes through the cylindrical portion 77R1 and is exposed to the outside. The tubular guide portion 77R2 is attached to the exposed portion. The guide portion 77R2 is composed of, for example, a conductive member. In the present embodiment, the guide portion 77R2 guides the developing device 70 to the installation position P11 defined on the drum unit 60 during the installation of the developing device 70 in the apparatus body 11.

As shown in FIG. 15, the guide portion 791 is provided for the support frame 711R. Specifically, the guide portion 791 is integral to the guide member 79 composed of a conductive member, and the guide member 79 is fixed to the support frame 711R. It is noted that the guide portion 791 is an example of a second guide portion.

Figure 16:
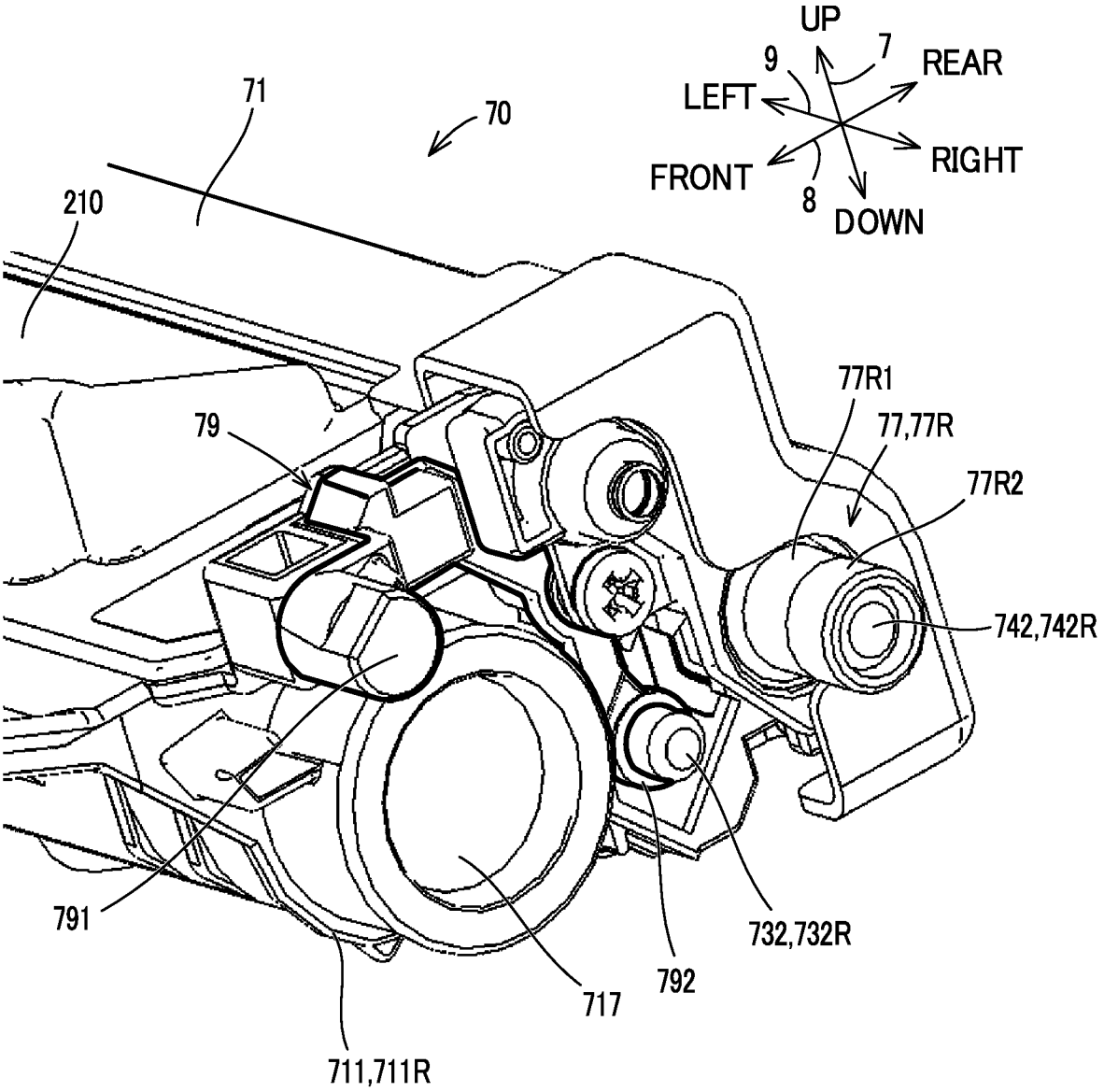
FIG. 16 is a perspective view of the developing device according to the embodiment of the present disclosure with its shaft cover removed from the right part.

FIG. 16 is a perspective view of the developing device 70, from the right part of which a shaft cover 712 (see FIG. 15) is being removed. As shown in FIG. 16, the support frame 711R has therein a bearing bore that supports the right shaft end 732R of the rotation shaft 732 of the supply roller 73. The shaft end 732R is placed through the bearing bore. The shaft cover 712 (see FIG. 15) is attached to the outer surface of the support frame 711R to cover the shaft end 732R. The shaft cover 712 is a member enclosed by bold solid lines in FIG. 15.

As shown in FIG. 16, the guide member 79 is attached to the outer surface of the support frame 711R. The guide member 79 is a member enclosed by bold solid lines in FIG. 16. The guide member 79 is composed of a member having electrical conductivity and includes the guide portion 791 and the connection portion 792. The connection portion 792 connects the support frame 711R to the shaft end 732R protruding outward. Thus, the rotation shaft 732 having electrical conductivity and the guide member 79 having electrical conductivity are connected also electrically.

The guide portion 791 is disposed in front of the bearing portion 77R at a predetermined distance. The guide portion 791 is a cylindrical member protruding outward from the outer surface of the support frame 711R. In the present embodiment, the guide portion 791 guides the front end part of the developing device 70 downward during the installation of the developing device 70 in the apparatus body 11.

In addition, as shown in FIGS. 15 and 16, the support frame 711R is provided with a cap member (cover member) 717 that closes a toner fill port formed in the support frame 711R. The toner fill port communicates with the inside of the housing 71 so that toner is supplied to the inside through the toner fill port.

A known developing device is provided with guide members on side parts of the developing device. However, the spaces on the side parts are insufficient to accommodate other members such as bearing portions and power receiving members in addition to the guide members. As a result, the housing of the developing device needs to be enlarged, preventing a reduction in the size of the developing device.

In contrast, as described above, the developing device 70 according to the present embodiment includes the bearing portions 77 (77L, 77R) provided for the pair of support frames 711. Accordingly, when the developing device 70 is inserted into the apparatus body 11 in which the drum unit 60 is installed, the guide portion 77L1 of the bearing portion 77L and the guide portion 77R2 of the bearing portion 77R provided for the developing device 70 are guided to the installation positions P11 (see FIG. 8) along the guide surfaces 112A of the apparatus body 11.

Specifically, the guide portion 77L1 and the guide portion 77R2 are inserted into the guide grooves 111 from the insertion openings 113 and reach the first inflection points P1 on the guide grooves 111. The guide portion 77L1 and the guide portion 77R2 then enter the guide grooves 112 from the upper end openings 114. Subsequently, the guide portion 77L1 and the guide portion 77R2 are guided to the installation positions P11 along the guide surfaces 112A of the guide grooves 112. After the guide portion 77L1 and the guide portion 77R2 are guided by the guide surfaces 112A and enter the guide grooves 646, the guide portion 77L1 and the guide portion 77R2 are guided to the installation positions P11 by the guide grooves 646. The guide portion 77L1 and the guide portion 77R2 guided to the installation positions P11 are restrained at the installation positions P11 by the stoppers 647.

During the installation of the developing device 70 in the apparatus body 11, the guide portions 78 and 791 that have entered the guide grooves 112 are guided approximately downward along the guide surfaces 112B of the guide grooves 112.

Thus, the developing device 70 is positioned on the drum unit 60 and locked to the drum unit 60 by the locking mechanism (not shown).

In addition, in the developing device 70 according to the present embodiment, the guide portion 77L1 provided for the bearing portion 77L and the guide portion 77R2 provided for the shaft end 742R are used as members to be guided during the installation of the developing device 70. In other words, the bearing portions 77L and 77R also function as guide members when the developing device 70 is installed in and removed from the apparatus body 11. This reduces or eliminates members disposed on the side parts of the developing device 70, resulting in a reduction in the size of the housing 71 of the developing device 70.

In the present embodiment, when the developing device 70 is in the installed state, the guide portion 791 is in contact with the supply terminal 117, and the supply bias is applied from the supply terminal 117 to the rotation shaft 732 through the guide portion 791, the guide member 79, and the connection portion 792. In addition, the guide portion 77R2 of the bearing portion 77R is in contact with the supply terminal 116, and the developing bias is applied from the supply terminal 116 to the rotation shaft 742 through the guide portion 77R2. That is, the guide member 79 also functions as a power receiving terminal (power receiving portion) for receiving the supply bias, and the bearing portion 77R also functions as a power receiving terminal (power receiving portion) for receiving the developing bias. This eliminates the need for power receiving terminals to be disposed on the side parts of the developing device 70, thereby further reducing or eliminating members disposed on the side parts. As a result, the size of the housing 71 of the developing device 70 can be further reduced.

As shown in FIG. 9, the developing device 70 is provided with two handles 200. The handles 200 are parts that users hold using their thumbs and fingers when the developing device 70 is installed in or removed from the apparatus body 11 or when the developing device 70 is grasped or carried.

The handles 200 are disposed on the front face 714 (an example of a side face) of the housing 71. More specifically, the two handles 200 are disposed in an upper end part of the front face 714 at a distance from each other in the left-right direction 9. In the present embodiment, the two handles 200 are disposed in the upper end part, one on each end in the left-right direction 9. The handles 200 are integral to the housing 71. In the present embodiment, the handles 200 are provided for the housing 71. However, the handles 200 may be provided for any part of the developing device 70 instead of the housing 71 as long as the handles 200 can be used for holding the developing device 70. Moreover, the attachment positions of the handles 200 are not limited to on the front face 714 of the housing 71 and may be on the upper surface 715, the lower surface 716, or the left and right faces (for example, the pair of support frames 711) of the housing 71. In addition, the number of handles 200 is not limited to two, and may be, for example, one or three or more. It is noted that, in a case where only one handle 200 is provided, the handle 200 is preferably disposed in the middle of the upper end part on the front face 714. In addition, it is noted that, in a case where three or more handle 200 are provided, the handles 200 are preferably disposed in the upper end part on the front face 714 at regular intervals in the left-right direction 9.

Figure 17:
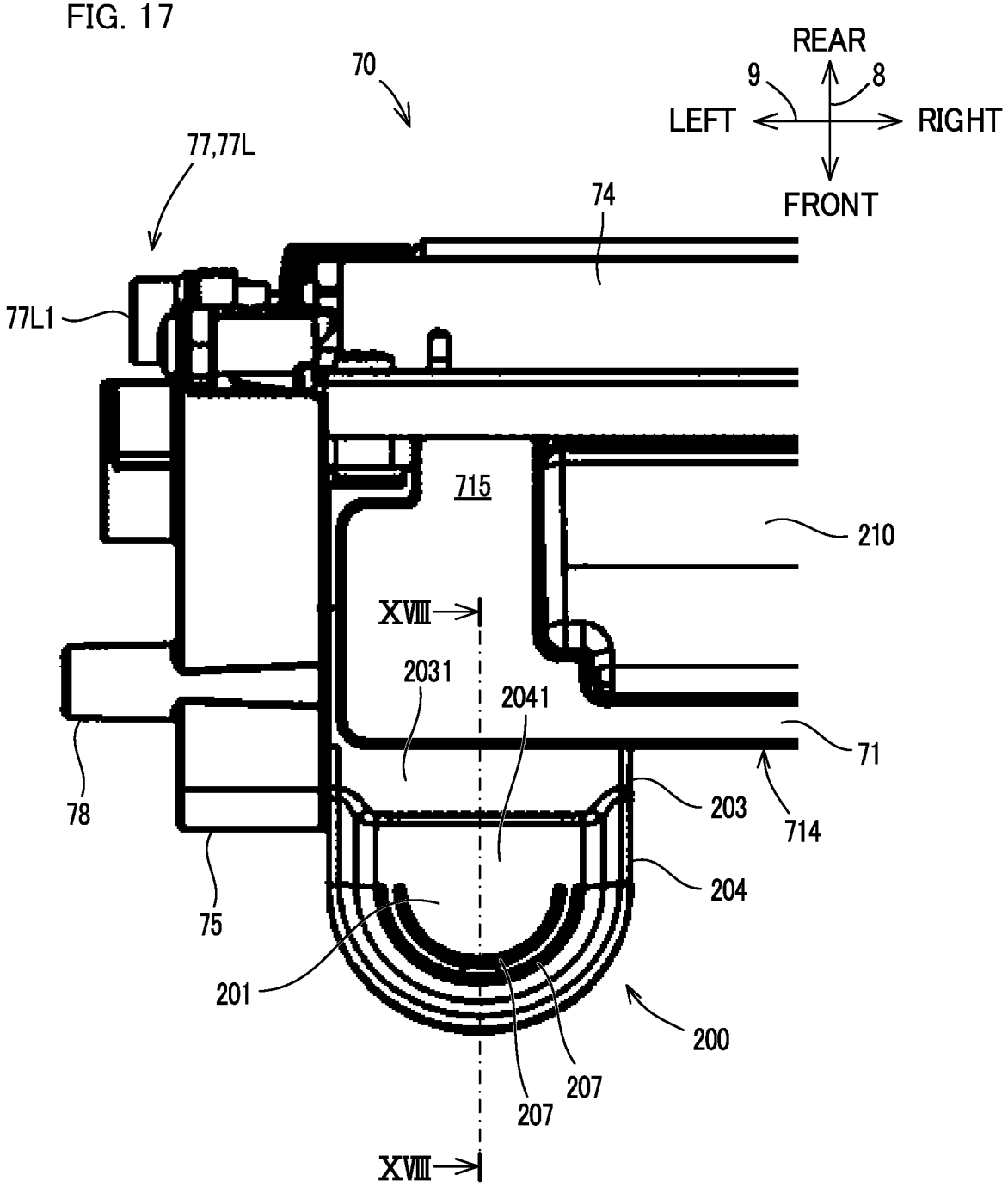
FIG. 17 is an enlarged plan view of the left part of the developing device according to the embodiment of the present disclosure.
Figure 18:
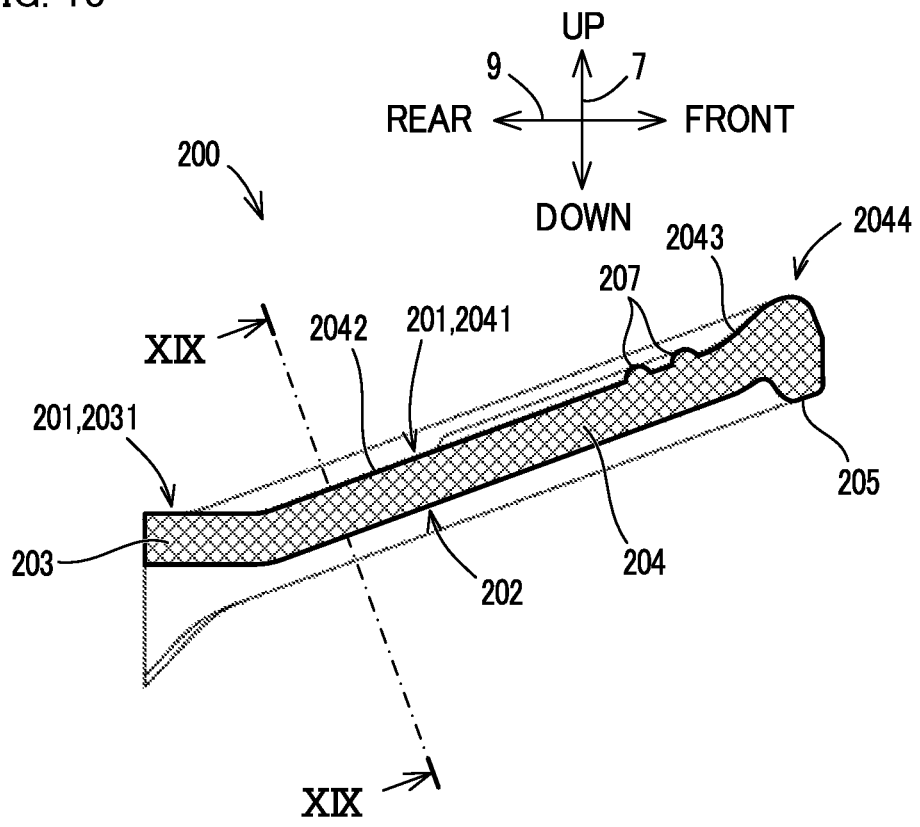
FIG. 18 is a cross-sectional view taken along cutting plane XVIII-XVIII in FIG. 17 and is a partial enlarged view of a handle provided for the developing device according to the embodiment of the present disclosure.
Figure 19:
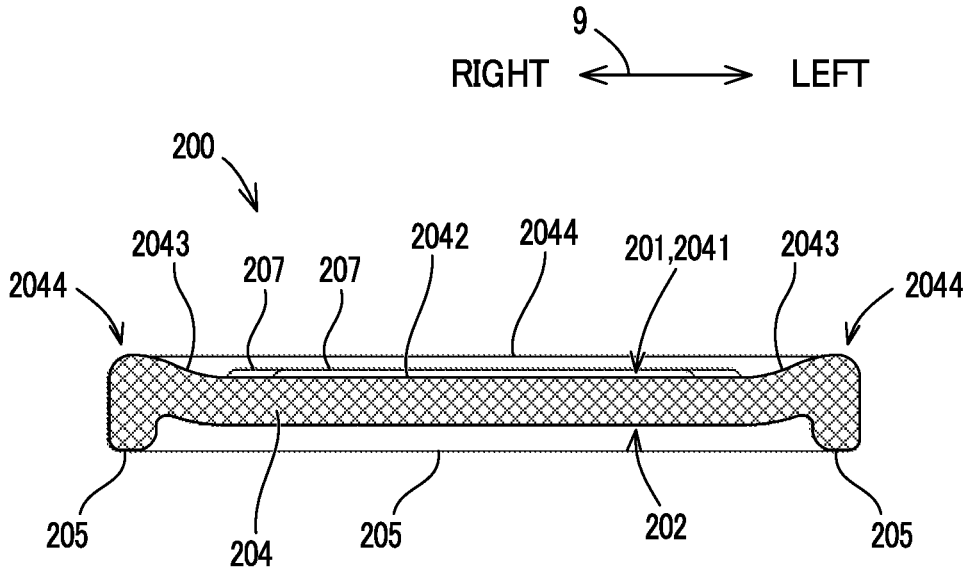
FIG. 19 is a cross-sectional view taken along cutting plane XIX-XIX in FIG. 18 and is a partial enlarged view of the handle provided for the developing device according to the embodiment of the present disclosure.

FIG. 17 is an enlarged view of the left part of the developing device 70. As shown in FIG. 17, the handles 200 protrude forward from the front face 714. The handles 200 are plate-like members extending forward. As shown in FIGS. 18 and 19, the upper surfaces 201 of the handles 200 are curved. Here, FIG. 18 is a cross-sectional view taken along cutting plane XVIII-XVIII in FIG. 17 and is a partial enlarged view of the left handle 200 provided for the developing device 70. In addition, FIG. 19 is a cross-sectional view taken along cutting plane XIX-XIX in FIG. 18 and is a partial enlarged view of the left handle 200.

In the present embodiment, the upper surfaces 201 of the handles 200 are curved. However, the lower surfaces 202 (see FIG. 18) of the handles 200, for example, may be curved instead of the upper surfaces 201.

In the present embodiment, the handles 200 each include a base portion 203 protruding forward from the front face 714 and a grip portion 204 extending forward (that is, protruding direction of the handles 200) from the base portion 203. As shown in FIG. 18, an inclined surface 2041, which is part of the upper surface 201 of the handle 200, on the upper side of the grip portion 204 is curved.

As shown in FIGS. 17 and 18, the base portion 203 has an upper surface 2031 (an example of a first upper surface) perpendicular to the front face 714 of the housing 71. In addition, as shown in FIG. 18, the grip portion 204 is bent obliquely forward and upward relative to the base portion 203. That is, the grip portion 204 has the inclined surface 2041 in an upper part thereof. The inclined surface 2041 is bent obliquely upward relative to the upper surface 2031 of the base portion 203 to extend obliquely upward. The inclined surface 2041 forms a predetermined angle (angle greater than 90 degrees) with the upper surface 2031. The angle is within a range of, for example, 150 degrees to 180 degrees and, more preferably, within a range of 165 degrees to 175 degrees. In each handle 200, the inclined surface 2041 of the grip portion 204 is curved. In addition, the upper surface 2031 of the base portion is flat and is not curved.

In the present embodiment, the upper surfaces of the grip portions 204 are inclined obliquely forward and upward. However, the configuration is given for illustration, and the grip portions 204 may have other shapes. For example, the upper surfaces of the grip portions 204 may extend horizontally or inclined obliquely forward and downward. In any configuration, the upper surfaces of the grip portions 204 may have any shape as long as the central part is curved and recessed.

Specifically, as shown in FIGS. 18 and 19, the inclined surface 2041 of each grip portion 204 includes a flat bottom surface 2042 formed in the central part thereof and a curved surface 2043 located at the outer peripheral portion 2044 of the grip portion 204 and adjoining the bottom surface 2042. The bottom surface 2042 and the curved surface 2043 cause the inclined surface 2041 of the grip portion 204 to be recessed in the central part (bottom surface 2042) in a concave manner and curved as a whole.

When a user holds the handles 200 configured as above by pinching the handles 200 between their thumbs and index fingers, the thumbs placed on the inclined surfaces 2041 on the upper sides of the grip portions 204 fit the curved shape. Accordingly, the user can grasp the grip portions 204 firmly using their thumbs and their index fingers placed on the lower surfaces 202. Thus, the developing device 70 can be held easily and is prevented from being dropped during installation and removal of the developing device 70. In addition, the developing device 70 can be installed in and removed from the image forming apparatus smoothly.

It is noted that the shape of the inclined surface 2041 (see FIG. 18) of each grip portion 204 is not necessarily curved by the bottom surface 2042 and the curved surface 2043. For example, the inclined surface 2041 may have a deepest point in the central part and curved from the deepest point to the outer peripheral portion 2044. In addition, the inclined surface 2041 may have an arc shape in cross-section passing through the deepest point.

In addition, protruding portions 205 protruding perpendicularly downward from the lower surfaces 202 of the grip portions 204 are disposed on the outer peripheral portions 2044. The protruding portions 205 extend over the entire outer peripheral portions 2044. That is, the lower surfaces 202 of the handles 200 are curved in a concave manner by the protruding portions 205. This causes the thumbs or fingers of the user placed on the lower surfaces 202 to be caught by the protruding portions 205 more easily. Thus, the user can hold the handles 200 more securely and easily.

As shown in FIG. 17, each outer peripheral portion 2044 is formed into a round shape. Specifically, the protruding end in the front (facing the protruding direction) of the outer peripheral portion 2044 is rounded. The outer peripheral portion 2044 has, for example, a semicircular shape.

Furthermore, rounded ribs 207 protrude from the upper surface of each grip portion 204, that is, from the inclined surface 2041 inside the outer peripheral portion 2044. As shown in FIG. 17, the ribs 207 have the same round shape as the outer peripheral portion 2044 and are formed into, for example, a semicircular shape. In the present embodiment, two ribs 207 are formed on each inclined surface 2041. This causes the thumbs or fingers of the user to be caught by the ribs 207 when the user grasps the inclined surfaces 2041 of the grip portions 204, allowing the user to grasp the handles 200 more easily.

As shown in FIG. 9, the housing 71 of the developing device 70 is provided with an expanded portion 210 that is expanded upward. The expanded portion 210 is disposed on the upper surface 715 of the housing 71. In other words, the expanded portion 210 is disposed on the upper surface 715 at an upper position in the up-down direction 7 (transverse direction) orthogonal to the longitudinal direction (left-right direction 9) of the housing 71. The expanded portion 210 extends in the longitudinal direction on the upper surface 715 and is integral to the housing 71. It is noted that, in a case where the housing 71 is composed of a lower housing that can store developer and a cover member that closes an opening in the upper surface of the lower housing, the expanded portion 210 may be integral to the cover member or may function as the cover member.

In the present embodiment, the expanded portion 210 is disposed on the upper surface 715 of the housing 71. However, the configuration is given for illustration and is not intended to limit the present disclosure. The expanded portion 210 may be disposed on either side of the housing 71 in the transverse direction. For example, the expanded portion 210 may be disposed on the front face 714 or on the lower surface 716 (see FIG. 20) of the housing 71.

Figure 20:
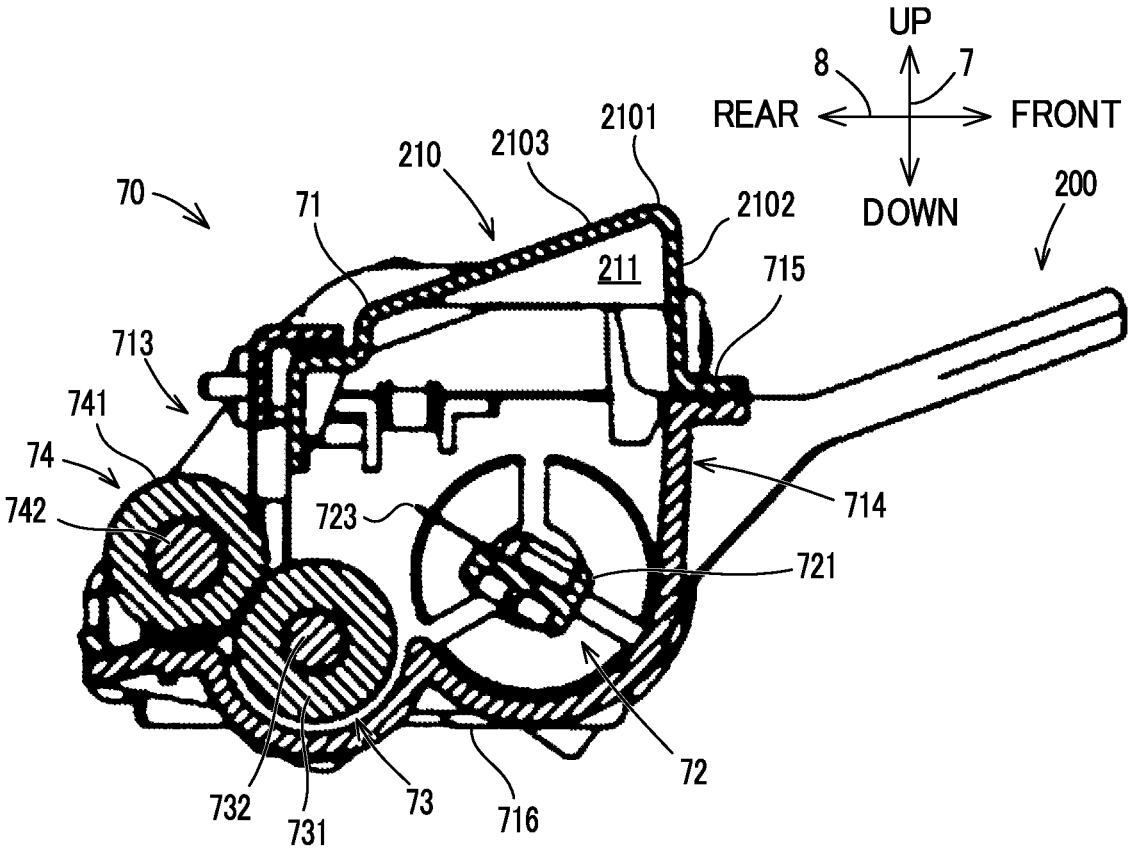
FIG. 20 is a cross-sectional view, taken along cutting plane XX-XX in FIG. 11, showing the configuration inside the developing device according to the embodiment of the present disclosure.

FIG. 20 is a cross-sectional view taken along cutting plane XX-XX in FIG. 11. As shown in FIG. 20, the expanded portion 210 expands upward (outward) from the upper surface 715 to increase the storage capacity inside the housing 71. Thus, the storage capacity for developer inside the housing 71 is increased by the volume of a cavity 211 inside the expanded portion 210.

In the present embodiment, the expanded portion 210 has a substantially triangular shape when viewed from the side, and has a vertical surface 2102 extending downward from a top portion 2101 in the front of the expanded portion 210 and an inclined surface 2103 extending obliquely backward and downward from the top portion 2101 when viewed in cross-section. As a result, the rear part of the developing device 70, that is, a part of the developing device 70 facing a direction along which the developing device 70 is inserted into the apparatus body 11 has a height less than the height of the front part. This facilitates the installation of the developing device 70 in the apparatus body 11.

Figure 21:
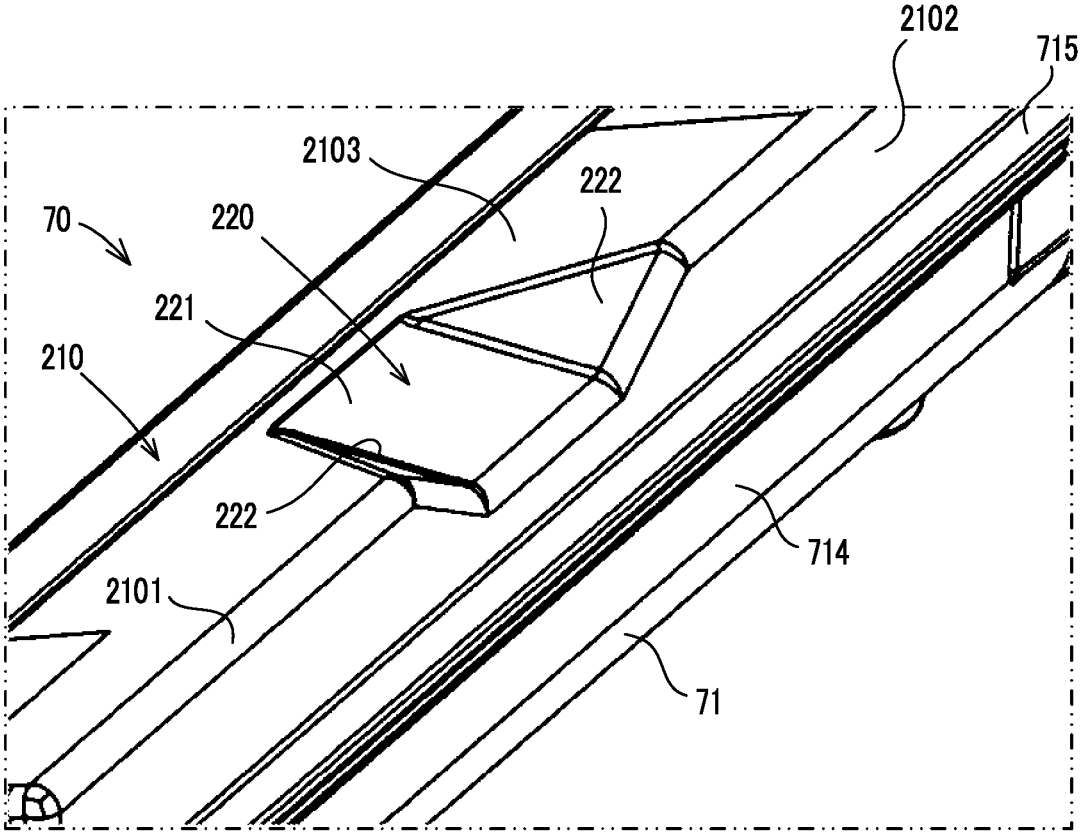
FIG. 21 is an enlarged perspective view of the middle part of the upper surface of the developing device according to the embodiment of the present disclosure.

FIG. 21 is an enlarged view of the central part of the expanded portion 210 of the developing device 70. As shown in FIG. 21, a recessed portion 220 is created in the central part of the expanded portion 210. The recessed portion 220 is located in the central part of the expanded portion 210 in the longitudinal direction.

The recessed portion 220 extends in the front-rear direction 8 in the expanded portion 210. The recessed portion 220 is a portion recessed downward in the central part of the expanded portion 210 and has a groove shape surrounded by the bottom surface 221 and a pair of side faces 222 each inclined from the top portion 2101 and the inclined surface 2103 to the bottom surface 221. The bottom surface 221 is parallel to the upper surface 715. The side faces 222 form a predetermined angle (angle greater than 90 degrees) with the bottom surface 221. The angle is within a range of, for example, 90 degrees, exclusive, to 150 degrees, inclusive.

Due to the above-described configuration of the recessed portion 220, a user can grip the developing device 70 by putting their thumb or fingers on the recessed portion 220 when holding the developing device 70 using one hand. This configuration allows the user to hold the developing device 70 more easily using one hand and to grip the developing device 70 firmly and stably using only one hand. As a result, the developing device 70 is prevented from being dropped during handling of the developing device 70.

In addition, for example, when a user cannot visually locate the developing device 70 in a reliable manner and gropes for the developing device 70 to hold it, the inclined side faces 222 provided for the recessed portion 220 allows the user to locate the position of the bottom surface 221 of the recessed portion 220 from a tactile sensation perceived by their thumb or fingers placed on the side faces 222. Thus, the user can shift their thumb or fingers to the bottom surface 221 of the recessed portion 220 to place their thumb or fingers on the recessed portion 220 reliably.

Figure 22:
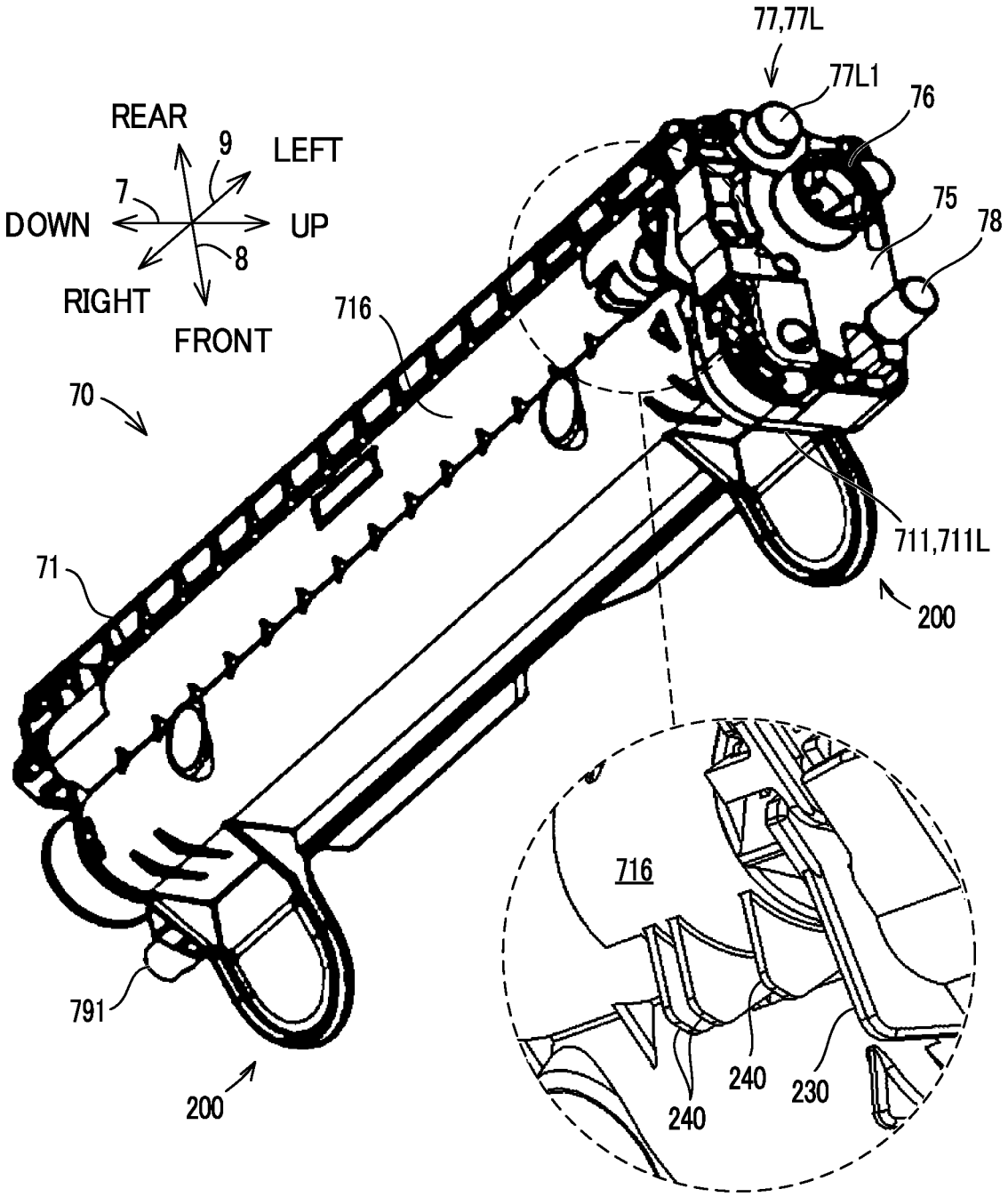
FIG. 22 is a perspective view of the developing device according to the embodiment of the present disclosure and shows the bottom surface of the developing device.
Figure 23:
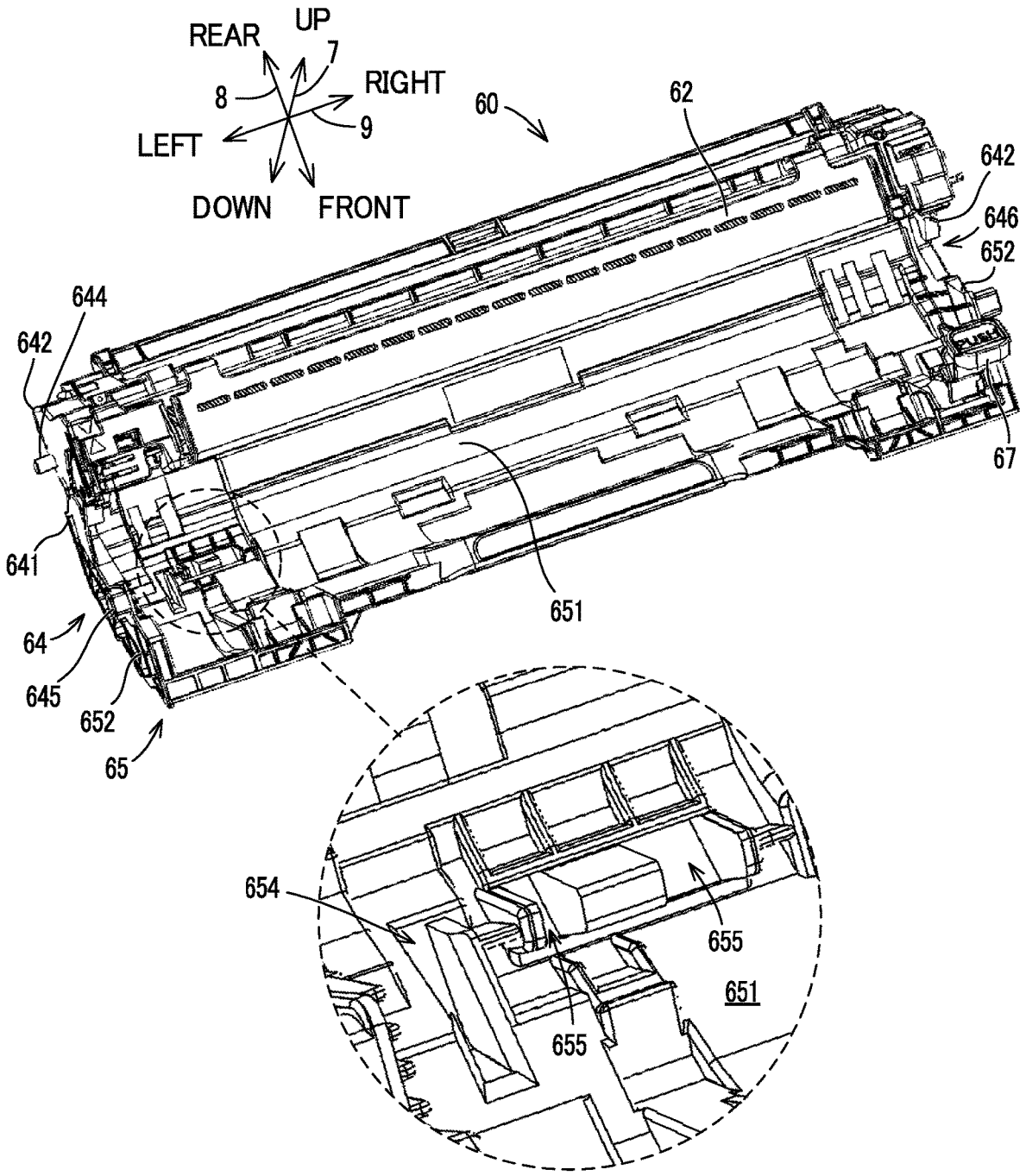
FIG. 23 is a perspective view of the drum unit provided for the image forming apparatus according to the embodiment of the present disclosure.

FIG. 22 is a perspective view of the developing device 70. FIG. 22 shows the lower surface 716 of the developing device 70, that is, the lower surface 716 of the housing 71. FIG. 23 is a perspective view of the drum unit 60 provided for the image forming apparatus 10.

As described above, the developing device 70 is detachably supported by the drum unit 60 serving as an installation member. More specifically, the developing device 70 is detachably supported by the developing-device support portion 65 (see FIG. 7) provided for the housing 64 of the drum unit 60. The developing device 70 needs to be prevented from being displaced while being installed on the developing-device support portion 65. To achieve this, as shown in FIG. 22, the housing 71 is provided with a positioning member 230.

The positioning member 230 is disposed on the lower surface 716 of the housing 71. The lower surface 716 is a surface to be supported when the developing device 70 is installed on the developing-device support portion 65. That is, the lower surface 716 of the developing device 70 is supported by the second base frame 651 (see FIG. 23) of the developing-device support portion 65. In the present embodiment, the positioning member 230 is disposed at the left end on the lower surface 716.

Although the positioning member 230 is disposed at the left end on the lower surface 716 in the present embodiment, the configuration is given for illustration and is not intended to limit the present disclosure. The positioning member 230 may be disposed in the middle of the lower surface 716 or at the right end. In addition, a plurality of positioning members 230 may be disposed on the lower surface 716.

When the developing device 70 is installed on the developing-device support portion 65 (installed state), the positioning member 230 engages with a slit 654 (positioning hole) created in the second base frame 651. Specifically, when the developing device 70 is in the installed state, the positioning member 230 is fitted in the slit 654. Thus, the developing device 70 is positioned so as not to be displaced in the front-rear direction 8 or in the left-right direction 9 relative to the developing-device support portion 65 of the drum unit 60.

The positioning member 230 protrudes perpendicularly from the lower surface 716. In addition, the positioning member 230 is a narrow rib-like member extending on the lower surface 716 in the transverse direction (for example, front-rear direction 8) orthogonal to the longitudinal direction (left-right direction 9) of the housing 71. In the present embodiment, the positioning member 230 extends in a direction along which the guide portions 77L1, 77R2, and 78 of the developing device 70 are guided (backward) when the developing device 70 is inserted to the installation position on the developing-device support portion 65.

As shown in FIG. 23, the developing-device support portion 65 has the slit 654 in the second base frame 651. The developing device 70 compatible with the developing-device support portion 65 of the drum unit 60, that is, the developing device 70 that can be installed on the developing-device support portion 65 of the drum unit 60 is provided with the positioning member 230 at a position that corresponds to the slit 654, that is, at a position that allows the positioning member 230 to be fitted in the slit 654. In this case, the developing device 70 is appropriately installed on the developing-device support portion 65 of the drum unit 60. That is, when the developing device 70 is installed on the developing-device support portion 65, the positioning member 230 is fitted in the slit 654.

In contrast, the developing device 70 incompatible with the developing-device support portion 65 of the drum unit 60 is provided with the positioning member 230 at a position that does not correspond to the slit 654, that is, at a position that prevents the positioning member 230 from being fitted in the slit 654. In this case, when the developing device 70 is inserted to the developing-device support portion 65 of the drum unit 60, the positioning member 230 abuts on the second base frame 651. As a result, the developing device 70 cannot be installed on the developing-device support portion 65 of the drum unit 60. In this manner, in the present embodiment, the positioning member 230 has a function similar to compatible members 240 (described later). That is, the positioning member 230 partially constitutes the compatible members 240.

In the present embodiment, the positioning member 230 is longer than the compatible members 240 (described later) in the transverse direction and protrudes further than the compatible member 240. In addition, the slit 654 has a length in the transverse direction and a depth corresponding to the positioning member 230. As a result, when the positioning member 230 is fitted in the slit 654, the developing device 70 can be precisely positioned relative to the developing-device support portion 65.

As shown in FIG. 22, the housing 71 is provided with the compatible members 240 adjacent to the positioning member 230. The compatible members 240 are essential members preventing developing devices inappropriate for the image forming apparatus 10 from being installed on the drum unit 60 and thereby preventing inappropriate developer from being supplied to the image forming apparatus 10. In the present embodiment, the compatible members 240 allow alternative installation on the drum unit 60. More specifically, the compatible members 240 allow only compatible developing devices 70 to be installed on the developing-device support portion 65 of the drum unit 60.

As shown in FIG. 22, three compatible members 240 are disposed on the lower surface 716. The compatible members 240 are disposed on the lower surface 716 of the housing 71 to be closer to the middle than the positioning member 230. The compatible members 240 have the same shape and protrude perpendicularly from the lower surface 716. In addition, the compatible members 240 are narrow rib-like members extending on the lower surface 716 in the transverse direction (for example, front-rear direction 8) of the housing 71. Compared with the positioning member 230, the compatible members 240 have a shorter length in the transverse direction and a shorter protruding length.

In the present embodiment, multiple compatible members 240 are provided. However, the configuration is given for illustration and is not intended to limit the present disclosure. Only one compatible member 240 may be disposed adjacent to the positioning member 230. In addition, the compatible members 240 do not necessarily need to be disposed adjacent to the positioning member 230 and may be disposed away from the positioning member 230 on the lower surface 716. For example, in the case where the positioning member 230 is disposed at the left end on the lower surface 716, the compatible members 240 may be disposed in the middle or at the right end on the lower surface 716.

When the developing device 70 is installed on the developing-device support portion 65, the compatible members 240 engage with slits 655 created in the second base frame 651. Specifically, when the developing device 70 is in the installed state, the compatible members 240 are fitted in the slits 655. In the present embodiment, the developing device 70 compatible with the developing-device support portion 65 of the drum unit 60 is provided with the compatible members 240 at positions that correspond to the slits 655, that is, at positions that allow the compatible members 240 to be fitted in the slits 655. In this case, the developing device 70 is appropriately installed on the developing-device support portion 65 of the drum unit 60. That is, when the developing device 70 is installed on the developing-device support portion 65, the compatible members 240 are fitted in the slits 655.

In contrast, the developing device 70 incompatible with the developing-device support portion 65 of the drum unit 60 is provided with the compatible members 240 at positions that do not correspond to the slits 655, that is, at positions that prevent the compatible members 240 from being fitted in the slits 655. In this case, when the developing device 70 is inserted to the developing-device support portion 65 of the drum unit 60, the compatible members 240 abut on the second base frame 651. As a result, the developing device 70 cannot be installed on the developing-device support portion 65 of the drum unit 60. Such a configuration that achieves installation compatibility using the compatible members 240 and the slits 655 is referred to as "compatibility assurance configuration" in general.

As described above, in the present embodiment, incompatible developing devices cannot be installed due not only to the compatible members 240 but also to the positioning member 230. Accordingly, the incompatible configuration can be achieved not only by the compatible members 240 but also by the positioning member 230. In other words, the positioning member 230 partially constitutes the incompatible configuration. As a result, combining the arrangement pattern of the compatible members 240 and the position of the positioning member 230 can increase the number of identifiable incompatible configurations corresponding to developing devices 70 of multiple types without increasing the number of compatible members 240. In addition, the small number of compatible members 240 can prevent the configuration of the lower surface 716 of the developing device 70 from being complicated, leading to an excellent engagement of the developing device 70 with the developing-device support portion 65. As a result, the developing device 70 can be smoothly installed on the developing-device support portion 65.

In the above-described embodiments, the developing device 70 is installed on the drum unit 60 installed in the image forming apparatus 10. However, the present disclosure is also applicable to a case where the housing 64 of the drum unit 60 is integral to the apparatus body 11 of the image forming apparatus 10.

In addition, in the above-described embodiments, the developing device 70 is detachable from the image forming apparatus 10. However, the present disclosure is also applicable to a toner container detachable from the image forming apparatus 10.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device detachably supported by an image forming apparatus, comprising:

a housing that can store developer inside the housing;

at least one developing roller rotatably provided for the housing;

a first support shaft composed of a conductive member and disposed at an axial end of the developing roller;

a support member including a first bearing portion that supports the first support shaft and constituting a side face of the housing in an axial direction of the developing roller; and a supply roller rotatably provided for the housing and disposed parallel to the developing roller at a position facing and adjacent to the developing roller, wherein the developing roller is disposed in the housing on a side in a direction of insertion along which the developing device is inserted to the installation position during the installation of the developing device, the supply roller is disposed in the housing on a side in a direction opposite the direction of insertion, the first bearing portion includes a first guide portion protruding outward from an outer surface of the support member and configured to be guided to an installation position of the developing device during installation of the developing device in the image forming apparatus, the supply roller includes a second support shaft composed of a conductive member and disposed at an axial end of the supply roller, the support member includes a guide member supporting the second support shaft and configured to guide the developing device to the installation position, the guide member is composed of a conductive member and includes:

a connection portion connected to a shaft end of the second support shaft that passes through a bearing bore formed in the support member and that protrudes outward from the outer surface of the support member; and a second guide portion configured to be guided to the installation position during the installation, the connection portion and the second guide portion are integral to the guide member, the second guide portion is in contact with a supply terminal for a supply bias provided for the image forming apparatus when the developing device is installed and located at the installation position, and when the second guide portion is in contact with the supply terminal, the supply bias is applied from the supply terminal to the second support shaft through the second guide portion, the guide member, and the connection portion.

2. The developing device according to claim 1, wherein the first guide portion is composed of a conductive member and is in contact with another supply terminal for a developing bias provided for the image forming apparatus when the developing device is installed and located at the installation position.

3. The developing device according to claim 1, wherein the second guide portion is disposed at a position away from the connection portion in the direction opposite the direction of insertion.

4. An image forming apparatus comprising:

the developing device according to claim 1; and a photoconductor drum having a surface on which a toner image is formed through a development process performed by the developing device.

5. The image forming apparatus according to claim 4, further comprising:

a drum unit by which the photoconductor drum is rotatably supported, wherein the drum unit includes a support portion configured to guide the developing device to the installation position during the installation and supporting the developing device at the installation position, and the support portion includes a guide groove configured to guide the first guide portion to the installation position during the installation.

* * * * *